US007773904B2

(12) United States Patent
Ushio

(10) Patent No.: US 7,773,904 B2
(45) Date of Patent: Aug. 10, 2010

(54) IMAGE FORMING APPARATUS HAVING THREE INPUT UNITS FOR INSTRUCTIONS

(75) Inventor: Masaru Ushio, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/036,994

(22) Filed: Feb. 25, 2008

(65) Prior Publication Data

US 2009/0103939 A1 Apr. 23, 2009

(30) Foreign Application Priority Data

Oct. 19, 2007 (JP) ..... 2007-272441

(51) Int. Cl.
*G03G 15/00* (2006.01)

(52) U.S. Cl. ..... 399/82; 399/383; 399/404

(58) Field of Classification Search ..... 399/82, 399/83, 84, 85, 397, 404, 405, 383, 403
See application file for complete search history.

(56) References Cited

U.S. PATENT DOCUMENTS 5,913,093 A * 6/1999 Yamanaka et al. ..... 399/82
6,029,026 A * 2/2000 Natsume et al. ..... 399/82
6,421,523 B1 * 7/2002 Kondo et al. ..... 399/404
6,871,851 B2 * 3/2005 Tamura et al. ..... 271/221
2007/0009278 A1 * 1/2007 Ohnishi et al. ..... 399/82

FOREIGN PATENT DOCUMENTS

JP 2004-217372 8/2004
JP 2004-268354 9/2004
JP 2006-012011 1/2006

OTHER PUBLICATIONS

Translation of Notice of Rejection issued by JPO on May 19, 2009, in connection with App. No. 2007-272441, 3 pgs.

* cited by examiner

*Primary Examiner*—David M Gray
*Assistant Examiner*—Joseph S Wong
(74) *Attorney, Agent, or Firm*—Squire, Sanders & Dempsey L.L.P.

(57) ABSTRACT

An image forming apparatus for forming an image on sheets, includes: a storage unit for storing the number of jobs in which a discharge position of the sheets is switched; a switching unit for switching the discharge position of the sheets; a sheet discharge unit for stacking the sheets; and a control unit for controlling the switching unit to switch the discharge position of the sheets per the number of jobs, which is stored in the storage unit, to discharge the sheets.

4 Claims, 16 Drawing Sheets

FIG. 6

D1

| | | |
|---|---|---|
| JOB ASSORTMENT OPERATION | ON | D11 |
| NUMBER OF JOBS | 100 | D12 |

FIG. 7

D2

| | | |
|---|---|---|
| NON-ASSORTED JOB COUNTER | 1 | D21 |
| NEXT DISCHARGE POSITION | 0 | D22 |

FIG. 8

D3

| | | |
|---|---|---|
| JOB CREATION COUNTER | M | D31 |
| JOB EXECUTION COUNTER | N | D32 |

FIG. 9

R1

| JOB NAME | JOB DATA STORAGE ADDRESS |
|---|---|
| JOB1(N+0) | * * * * * * * * |
| JOB2(N+1) | * * * * * * * * |
| JOB3(N+2) | * * * * * * * * |
| ⋮ | ⋮ |

FIG.10

131

| | | | | |
|---|---|---|---|---|
| 131a | PAGE COMMON DATA | | SET NUMBER OF COPIES | 1 | D41 |
| | | | NUMBER OF ALREADY OUTPUTTED COPIES | 0 | D42 |
| | | | COPY MODE | ONE SIDE | D43 |
| | | | SHEET FEED TRAY | TRAY 1 | D44 |
| | | | POST-PROCESSING MODE | SORT | D45 |
| | | | ASSORTMENT | NONE | D46 |
| | | | ASSORTED SHEET DISCHARGE POSITION | 0 | D47 |
| | | | PRINT PAGE NUMBER | 1 | D48 |
| | | | NUMBER OF ALREADY READ IMAGES | 1 | D49 |
| | | | SHEET FEED COUNTER | 0 | D50 |
| | | | SHEET DISCHARGE COUNTER | 0 | D51 |
| | | | LAST PAGE | 0 | D52 |
| 131b | INDIVIDUAL PAGE DATA | PAGE1 | IMAGE STORAGE ADDRESS | * * * * * * * * | D53 |
| | | | | | |
| | | PAGE2 | IMAGE STORAGE ADDRESS | * * * * * * * * | |
| | | | | | |
| | | ⋮ | ⋮ | ⋮ | |
| | | PAGEm | IMAGE STORAGE ADDRESS | * * * * * * * * | |
| | | | | | |

IMAGE FORMING APPARATUS HAVING THREE INPUT UNITS FOR INSTRUCTIONS

BACKGROUND OF THE INVENTION

1. Field of the Invention

The present invention relates to an image forming apparatus such as a copier, a printer and a facsimile machine or the like.

2. Description of the Related Art

In recent years, in an image forming apparatus that executes a plurality of jobs and stacks sheets relating to such execution of the jobs on a sheet discharge tray, the sheets relating to the execution of the plurality of jobs have mixedly existed on the one sheet discharge tray. Therefore, cumbersome work to find the sheets relating to each job has occurred, and work efficiency has been decreased.

In this connection, there are technologies for changing a discharge position of the sheets discharged to the sheet discharge tray in each job, or technologies for differentiating a discharge position of a first sheet of each job from those of the other sheets thereof.

For example, JP-Tokukai-2004-268354A discloses a printer, which includes: a number-of-copies setting unit that sets the number of copies to be bundled in the case of a job of sorting the sheets per the number of copies; and a system control unit that controls a sheet discharge control unit to sort the sheets per the set number of copies.

Moreover, JP-Tokukai-2006-12011A discloses an image forming apparatus that forms a banner image of a user name or the like on a predetermined position of a sheet, which is associated in advance with the discharge position of the sheets, in the case of changing the discharge position.

However, such a technology disclosed in JP-Tokukai-2004-268354A is a technology for assorting the sheets per the set number of copies in a job in which a large number of copies are set. Moreover, such a technology disclosed in JP-Tokukai-2006-12011A is a technology for assorting the sheets for each job by the sheet on which the banner image is formed. Accordingly, for example, when a large number of jobs, in each of which the discharged number of sheets is small, such as one, is continuously executed in variable printing, and the sheets stacked on the sheet discharge tray are packed in boxes for each predetermined number of sheets, the sheets cannot be assorted per the number of jobs, and it is necessary for a user to count the number of sheets stacked on the sheet discharge tray, and to assort the sheets.

SUMMARY OF THE INVENTION

The present invention has been made in consideration for the above-described circumstances. It is an object of the preset invention to enhance convenience by reducing a load of work to assort the sheets relating to the plurality of jobs.

In order to achieve at lease one of the above-described objects, an image forming apparatus reflecting one aspect of the present invention, which forms an image on sheets, comprises: a storage unit for storing the number of jobs in which a discharge position of the sheets is switched; a switching unit for switching the discharge position of the sheets; a sheet discharge unit for stacking the sheets; and a control unit for controlling the switching unit to switch the discharge position of the sheets per the number of jobs, which is stored in the storage unit, to discharge the sheets.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein:

FIG. 6 is a table showing an example of job assortment setting data;

FIG. 7 is a table showing an example of job assortment data;

FIG. 8 is a table showing an example of job creation/execution data;

FIG. 9 is a table showing an example of a job list;

FIG. 10 is a table showing an example of job data;

DETAILED DESCRIPTION OF PREFERRED EMBODIMENT

A description will be made in detail of an embodiment of the present invention with reference to the drawings.

First, a description will be made of a configuration of the embodiment.

Figure 1:
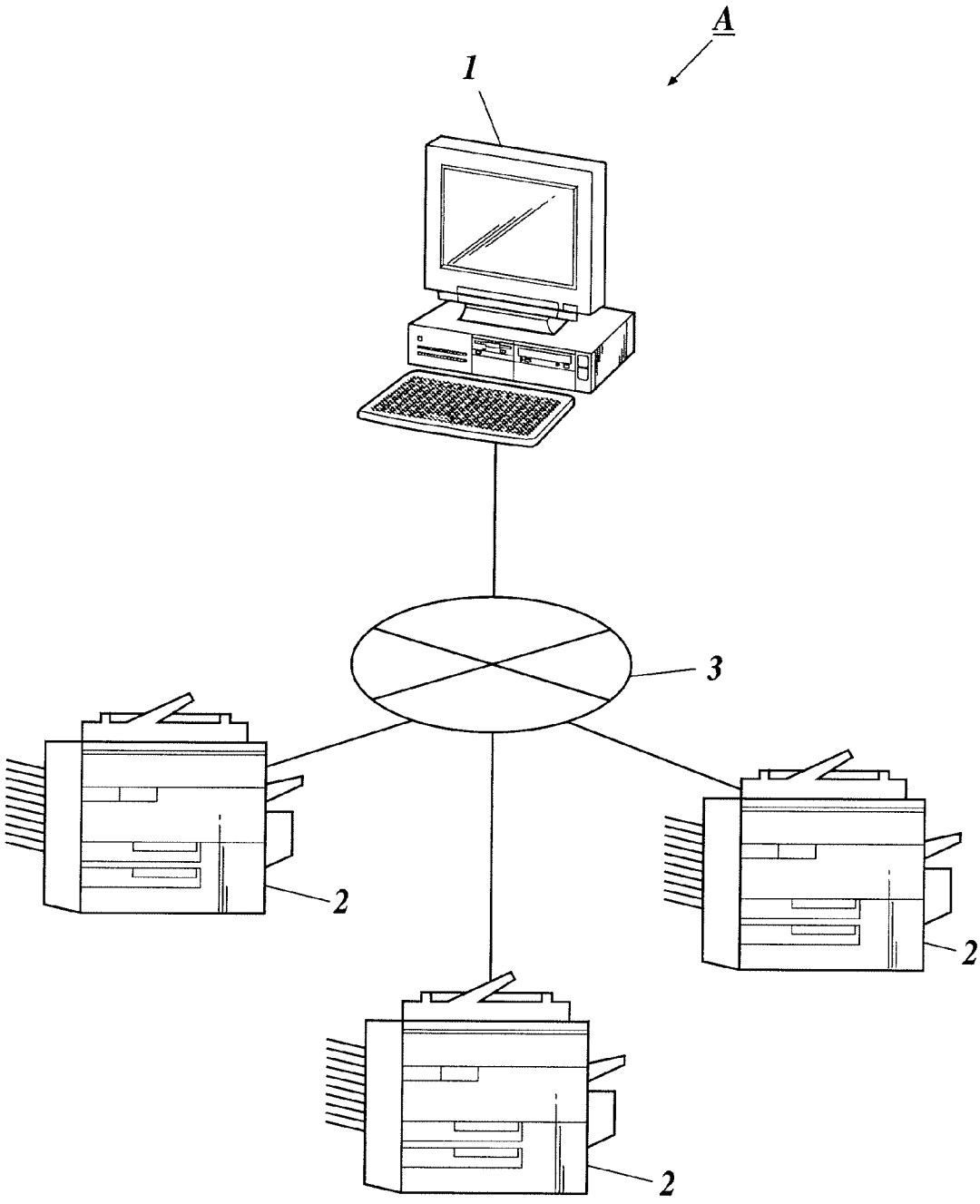
FIG. 1 is a view showing a configuration of an image forming system.

FIG. 1 shows a configuration of an image forming system A in this embodiment.

As shown in FIG. 1, the image forming system A includes an operation apparatus 1 and image forming apparatuses 2, which are communicably interconnected through a network 3. Note that, although FIG. 1 shows an example where one operation apparatus 1 and three image forming apparatuses 2 are interconnected, the numbers of the respective apparatuses to be installed are not particularly limited.

For the purpose of remotely operating the image forming apparatuses 2, the operation apparatus 1 transmits a variety of setting conditions set at the time of printing as well as image data to the image forming apparatuses 2, for example, when the image forming apparatuses 2 are controlled from the operation apparatus 1 to execute printing processing. As the operation apparatus 1, for example, an information processing apparatus such as a general-purpose PC is applicable.

Each of the image forming apparatuses 2 is an apparatus that combines an image forming function to form an image on sheets and a function to perform post processing such as offset processing for switching discharge positions of the sheets on which the image is formed and discharging the sheets, and that performs the processing in accordance with each setting instruction from an operation display unit provided on a main body of the apparatus or in accordance with a variety of setting instructions transmitted from the operation apparatus 1.

The network 3 may be a local area network (LAN) or a wide area network (WAN). Moreover, the network 3 may comprise: a telephone network, an integrated services digital network (ISDN), a broadband communication network, a private line, a mobile communication network, a communication satellite line, a community antenna television (CATV) network, an optical communication line, a wireless communication line, or the like; and internet service provider or the like, which interconnect these lines or networks.

First, a description will be made of the operation apparatus 1.

Figure 2:
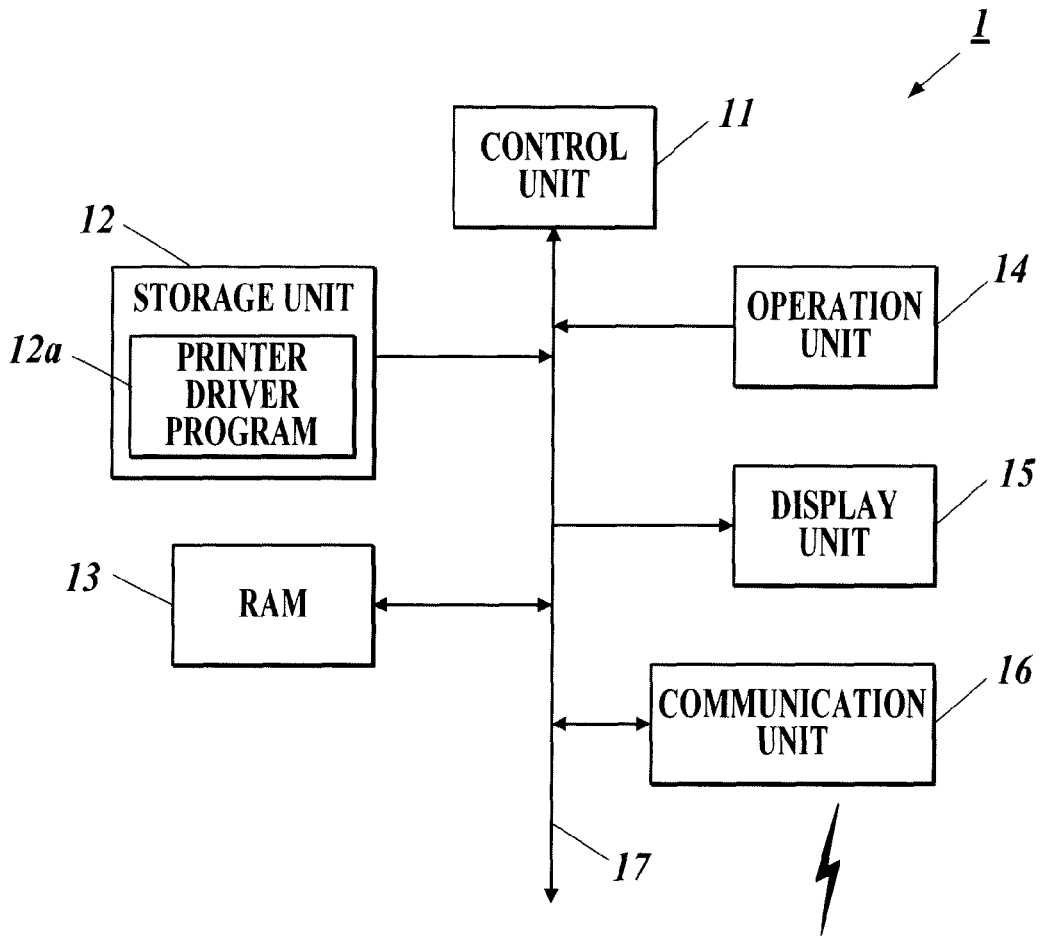
FIG. 2 is an internal configuration diagram of an operation apparatus.

FIG. 2 is an internal configuration diagram of the operation apparatus 1.

As shown in FIG. 2, the operation apparatus 1 includes: a control unit 11; a storage unit 12; a random access memory (RAM) 13; an operation unit 14; a display unit 15; a communication unit 16; and the like. The above units are communicably interconnected through a bus 17 and the like to each other.

The control unit 11 includes a central processing unit (CPU) and the like. The control unit 11 expands a system program, a variety of control programs, a variety of data and the like which are stored in the storage unit 12, into the RAM 13, and then controls the entire operations of the operation apparatus 1 in a comprehensive manner. Moreover, the control unit 11 executes a variety of processing in accordance with the programs expanded into the RAM 13, then stores results of the processing in the RAM 13, and displays the results on the display unit 15. Then, the control unit 11 stores the results of the processing, which have been stored in the RAM 13, in the storage unit 12.

Moreover, the control unit 11 executes print control processing and the like by using an application software program, a printer diver program 12*a* for allowing execution of a printer driver, and the variety of data, which are stored in the storage unit 12. Then, the control unit 11 stores the result of the processing in the RAM 13, and displays the result on the display unit 15.

The storage unit 12 includes a nonvolatile memory such as a read only memory (ROM) and a hard disk drive (HDD). The storage unit 12 stores the system program, the variety of control programs, a variety of application programs, the printer diver program 12*a*, the data relating to these programs, and the like.

The RAM 13 forms a work area that temporarily stores the variety of programs executed by the control unit 11 and the data relating to these programs.

The operation unit 14 comprises a keyboard composed of numeric keys, alphabetic keys, cursor moving keys, a variety of function keys, and the like, for entering the operation instructions for the inside of the operation apparatus 1 and the image forming apparatuses 2; and a pointing device such as a mouse. The operation unit 14 outputs depression signals by the keyboard and operation signals by the mouse as input signals.

The display unit 15 comprises a liquid crystal display (LCD) or the like. The display unit 15 displays a variety of setting screens on a display screen in accordance with display signals inputted from the control unit 11.

The communication unit 16 comprises a variety of interfaces such as a network interface card (NIC), a modulator-demodulator (MODEM), and a universal serial bus (USB) The communication unit 16 mutually transmits information to external devices (for example, the image forming apparatuses 2) located on the network 3 and receives information from the external devices.

Figure 3:
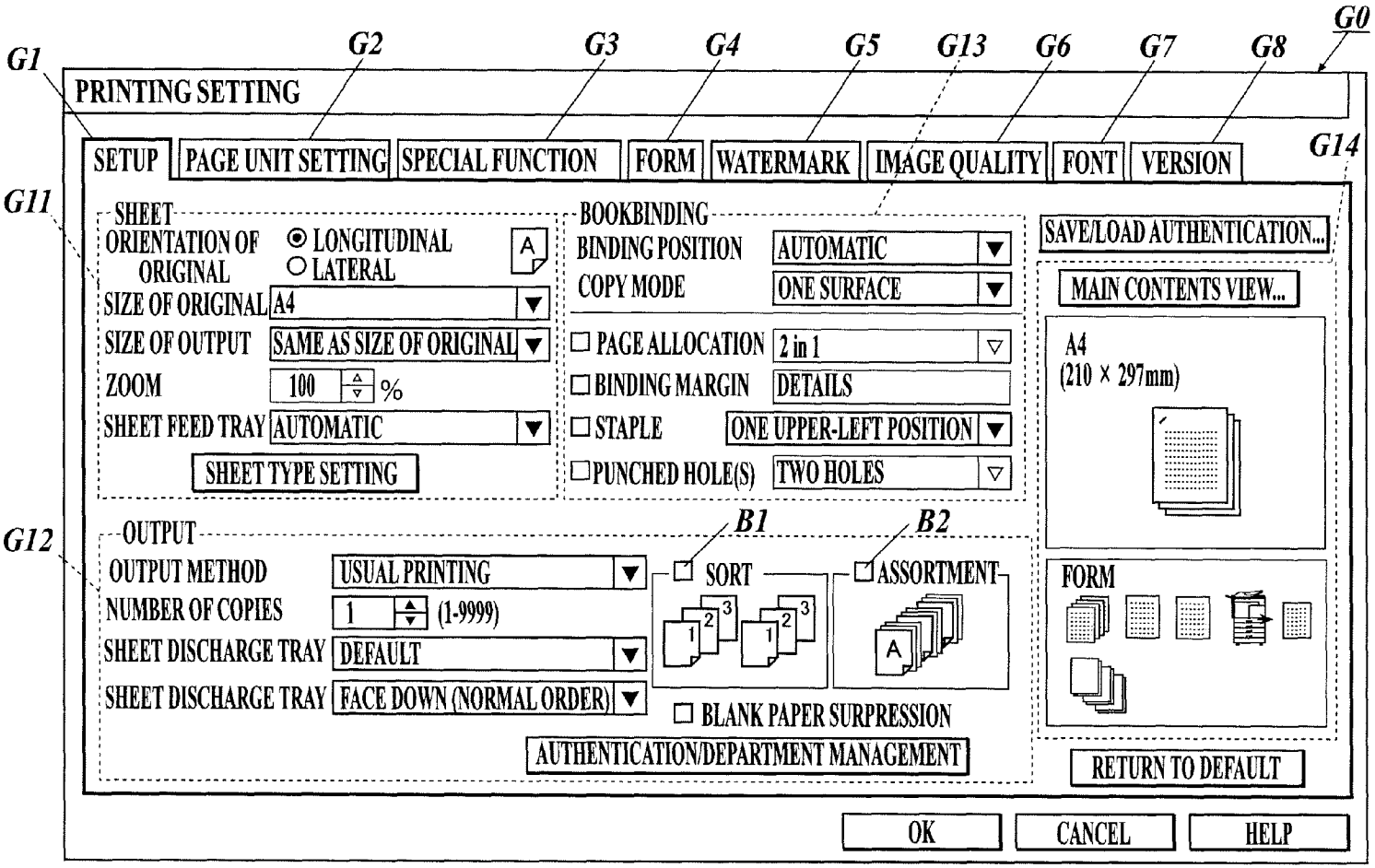
FIG. 3 is a view showing an example of a setup screen.

As an example of the variety of setting screens to be displayed on the display screen of the display unit 15, FIG. 3 shows an example of a setup screen G0 as a screen for entering and setting the variety of setting conditions in the printing processing when the image forming apparatus 2 is allowed to execute the printing processing.

The setup screen G0 shown in FIG. 3 includes: a setup index G1 having a sheet setting area G11, an output setting area G12, a bookbinding setting area G13, and a preview area G14; a page unit setting index G2 for switching to a page unit setting screen; a specialty screen index G3 for switching to a special function setting screen; a form index G4 for switching to a form setting screen; a watermark index G5 for switching to a watermark setting screen; an image quality index G6 for switching to an image quality setting screen; a font index G7 for switching to a font setting screen; a version index G8 for switching to a version confirmation screen that displays a revised edition of the printer driver; and the like.

The output setting area G12 includes: a sort setting button B1 that receives an instruction as to whether or not to apply a sort function to discharge discharged sheets in a page order; an assortment setting button B2 as a third input unit that receives an instruction as to whether or not to switch the discharge position of the sheets in the job itself; and the like. When the sort setting button B1 is checked, an instruction to apply the sort function is inputted, and when the assortment setting button B2 is checked, an instruction to switch the discharge position of the sheets in the job itself is inputted.

Next, a description will be made of the image forming apparatus 2.

Figure 4:
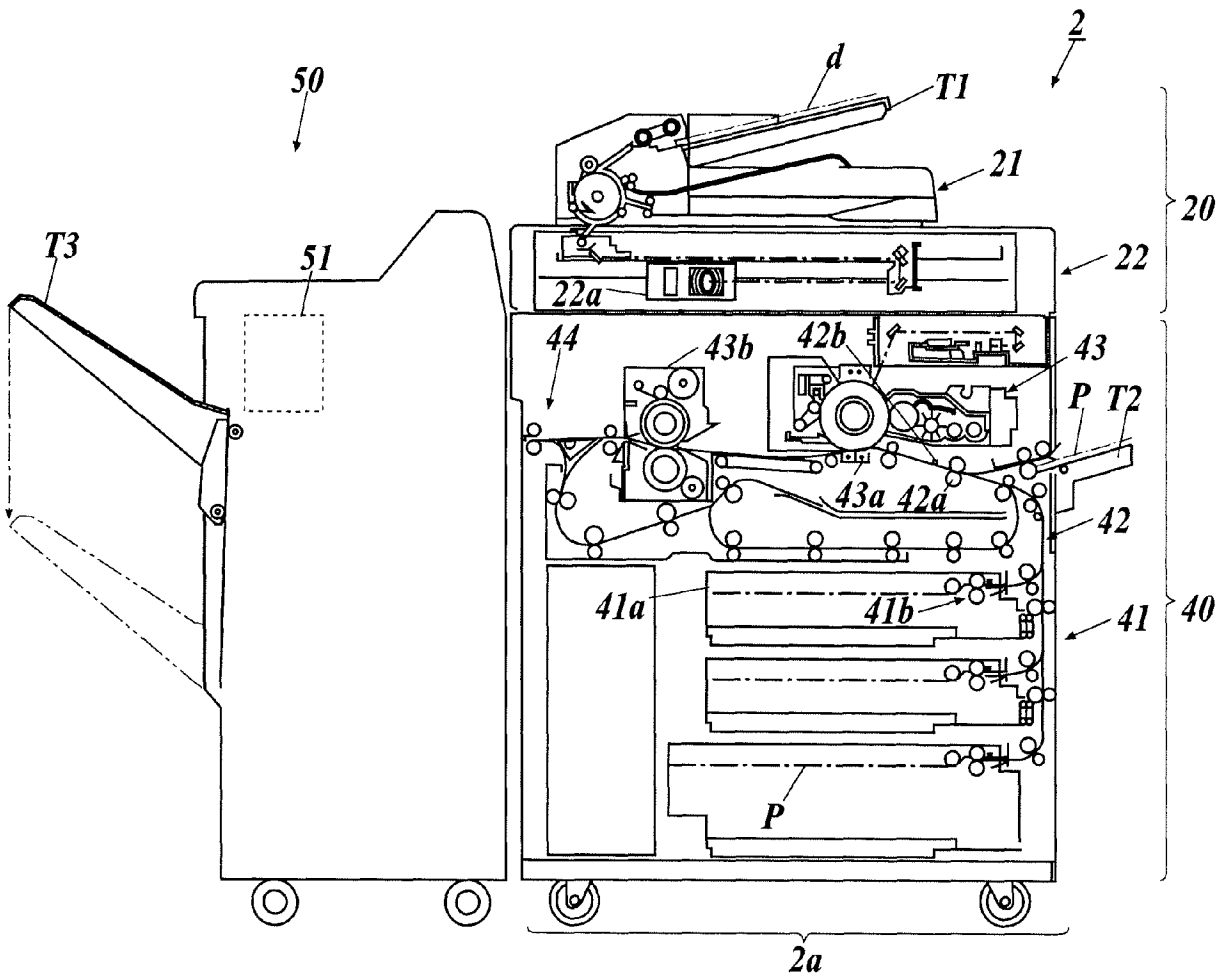
FIG. 4 is a schematic configuration cross sectional view of an image forming apparatus.

FIG. 4 is a schematic configuration cross sectional view of the image forming apparatus 2.

The image forming apparatus 2 includes: an image forming unit that reads an image from an original and forms the read image on sheets P, and that receives the image data from the operation apparatus 1 or the like and forms an image based on the image data; a post-processing unit that performs the post processing such as the offset processing for discharging the sheets on which the image is formed, to the set discharge position; and the like. As shown in FIG. 4, the image forming apparatus 2 comprises an image reading unit 20; a printing unit 40; and a post-processing unit 50.

The image reading unit 20 includes: an automatic original feed unit 21 called an auto document feeder (ADF); and a reading unit 22. An original d mounted on an original tray T1 of the automatic original feed unit 21 is conveyed to a contact glass as a reading spot of the reading unit 22. Then, images of both surfaces of the original d or an image of one surface of the original is scanned by an optical system of the reading unit 22, and the image is then read by a charge coupled device (CCD) 22*a*. Here, the term "image" includes not only image data of graphic forms, photographs and the like but also text data of characters, symbols and the like.

The image (analog image signal) read by the reading unit 22 is outputted to a control board 100 to be described later. Then, the A/D conversion and a variety of image processing are carried out for the image in the control board 100, and the image is then outputted to the printing unit 40.

Based on the inputted printing data, the printing unit 40 performs electrophotographic image forming processing. The printing unit 40 comprises: a sheet feed unit 41; a sheet conveyor unit 42; an image forming unit 43; and a delivery unit 44.

The sheet feed unit 41 includes a plurality of sheet feed trays 41*a* and a plurality of sheet feed units 41*b* and the like. The sheets P classified in advance in accordance with sizes and types are housed for each of the sheet feed trays 41*a*. Each of the sheet feed units 41*b* conveys the sheets P to the sheet conveyor unit 42 one by one from the uppermost.

The sheet conveyor unit 42 conveys the sheets P which are conveyed from the sheet feed trays 41*a* or a manual feed tray T2, to a transferring device 43*a* through a plurality of intermediate rollers and a plurality of resist rollers 42*a*, and the like.

Moreover, the sheet conveyor unit 42 conveys the sheets P on each one surface of which the image has been already formed, to a conveyor passage for double-sided printing by a conveyor passage switching plate, and conveys the sheets P to the transferring device 43*a* through the intermediate rollers and the resist rollers 42*a* again.

The image forming unit 43 includes: a photosensitive drum; an electric charging device; an exposure device; a development device; the transferring device 43*a*; a cleaning unit; and a fixing device 43*b*. Here, the exposure device includes a laser output unit that outputs a laser beam based on the image data, and a polygon mirror that scan the image in a main scanning direction by using the laser beam. Specifically, the image forming unit 43 irradiates the photosensitive drum electrically charged by the electric charging device with the laser beam by the exposure device, to form an electrostatic latent image. Then, the development device develops the electrostatic latent image formed on the photosensitive drum by a developer to form a toner image. In the transferring device 43*a*, the toner image on the photosensitive drum is transferred onto the sheets P. Moreover, after the toner image is transferred to the sheets P, residual toner and the like on a surface of the photosensitive drum are removed by the cleaning unit.

The fixing device 43*b* heats and fixes the toner image transferred onto the sheets P. The sheets P for which the fixing treatment is carried out are sandwiched by discharge rollers of the delivery unit 44, and are conveyed from a delivery port to the post-processing unit 50.

The post-processing unit 50 includes: an offset unit 51 as a switching unit that performs the offset processing for switching the discharge position of the sheets conveyed from the delivery unit 44 and discharging the sheets; and a sheet discharge tray T3 as a sheet discharge unit that stacks the sheets thereon. The post-processing unit 50 discharges the sheets to the set discharge position.

Note that the post-processing unit 50 may include a variety of post-processing units such as a sorting unit, a punching unit, a stapling unit, a folding unit, and a cutting unit.

Figure 5:
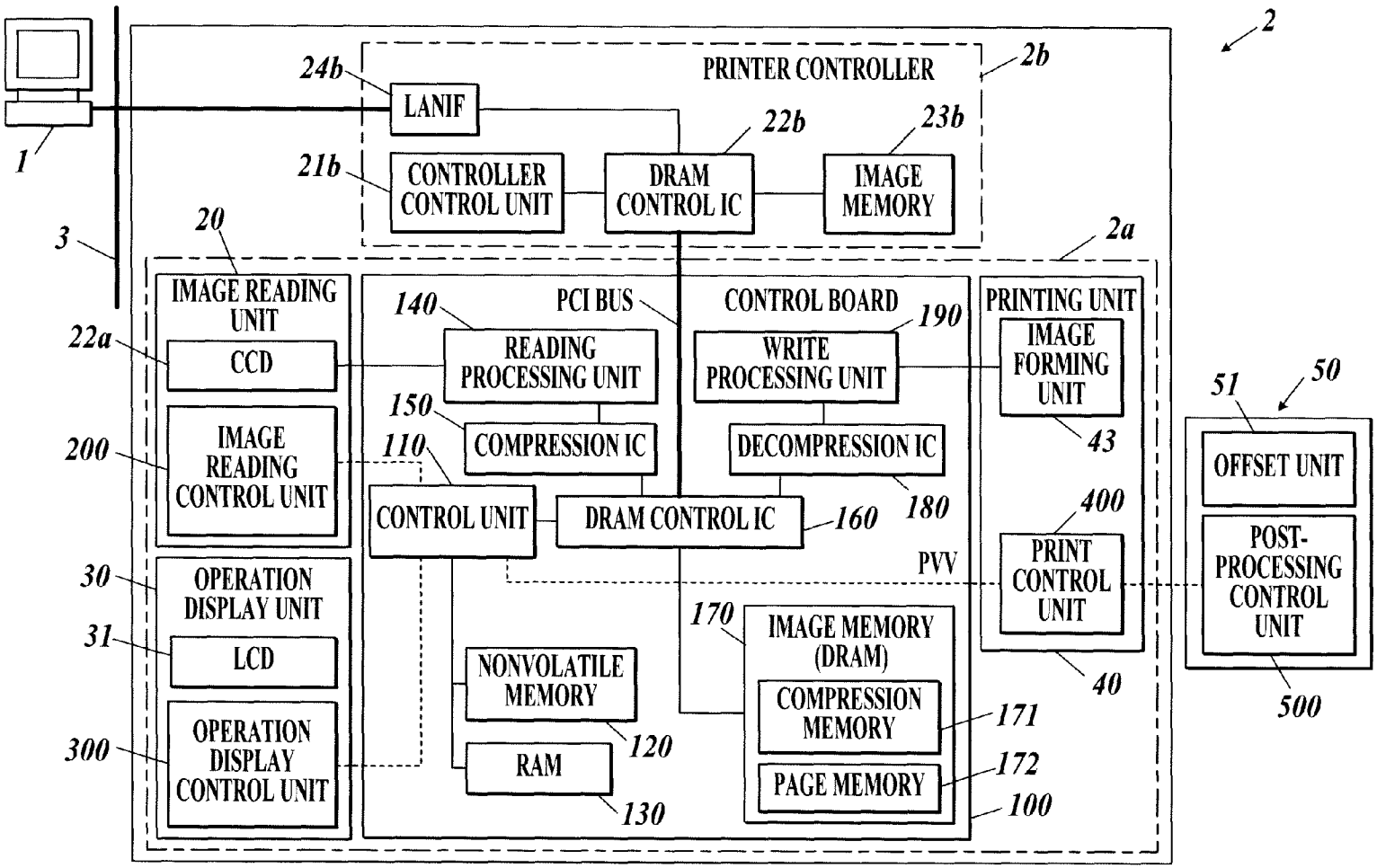
FIG. 5 is a control block diagram of the image forming apparatus.

FIG. 5 is a control block diagram of the image forming apparatus 2.

As shown in FIG. 5, the image forming apparatus 2 comprises: a body unit 2*a*; a printer controller 2*b*; and the post-processing unit 50 connected to the body unit 2*a*. The image forming apparatus 2 is connected to the operation apparatus 1 on the network 3 through a local area network interface (LANIF) 24*b* of the printer controller 2*b* so as to be capable of mutually transmitting information to the operation apparatus 1 and receiving the information from the operation apparatus 1.

The body unit 2*a* comprises the image reading unit 20; an operation display unit 30; the printing unit 40; and the control board 100. Note that the same reference numeral will be assigned to the same member as each member described with reference to FIG. 4, and a description thereof will be omitted.

The control board 100 comprises: a control unit 110; a nonvolatile memory 120; a random access memory (RAM) 130; a reading processing unit 140; a compression IC 150; a dynamic random access memory (DRAM) control IC 160; an image memory 170; an decompression IC 180; and a write processing unit 190.

The control unit 110 comprises a central processing unit (CPU) and the like, and controls the operations of each unit of the image forming apparatus 2 in a centralizing manner in accordance with a variety of processing programs stored in the nonvolatile memory 120. For example, in accordance with instruction signals inputted from the operation display unit 30 and the operation apparatus 1, the control unit 110 switches to a copier mode, a printer mode and a scanner mode, and controls the copying, the printing, the reading of the image data, and the like.

Moreover, the control unit 110 transmits an image write signal PVV to a print control unit 400 of the printing unit 40. The case where the image write signal PVV is in an ON state is defined as a state where the toner image formed on the photosensitive drum is transferred onto the sheets P in the transferring device 43*a*. The case where the image write signal PVV is in an OFF state is defined as a state where the toner image formed on the photosensitive drum is not transferred onto the sheets P in the transferring device 43*a*.

Moreover, in order to realize this embodiment, the control unit 110 controls each unit as follows. The control unit 110 controls the nonvolatile memory 120 to store an instruction to switch the discharge position of the sheets per the number of jobs inputted in the operation display unit 30 and an instruction on the number of jobs, as job assortment setting data. Then, the control unit 110 reads out a program for job assortment processing according to this embodiment, the job assortment setting data and the like from the nonvolatile memory 120, and reads out a variety of necessary data such as job assortment data, job creation/execution data, a job list and job data which will be described later, from the RAM 130. Subsequently, by using the program and the data, the control unit 110 controls the offset unit 51 so as to switch the discharge position of the sheets and to discharge the sheets by per the set number of jobs.

In particular, when the instruction to switch the discharge position of the sheets per the number of jobs is set in the job assortment setting data in the case of executing the job assortment processing, the control unit 110 controls the offset unit 51 so as to switch the discharge position of the sheets and to discharge the sheets per the number of jobs excluding the job in which the instruction to switch the discharge position of the sheets in the job itself is inputted (job in which the assortment setting button B2 is checked).

Besides the variety of processing programs and data relating to the image forming, the nonvolatile memory 120 stores a program for the job assortment processing according to this embodiment, the job assortment setting data, data for setting the post processing for the sheets P on which the image is formed, to the post-processing unit 50 through the printing unit 40, the data processed by the variety of programs, and the like.

FIG. 6 shows an example of the job assortment setting data.

As shown in FIG. 6, the job assortment setting data D1 is data stored based on a signal inputted from the operation display unit 30. The job assortment setting data D1 includes: a job assortment operation D11 indicating ON when there is an instruction to switch the discharge position of the sheets per the number of jobs, that is, when there is an instruction to execute the job assortment processing of this embodiment, and indicating OFF where there is not such an instruction; and the number of jobs D12, which indicates the number of jobs which are instructed when the job assortment operation data is ON.

The RAM 130 forms a work area that temporarily stores the variety of programs executed by the control unit 110 and the data related to these programs, the job assortment data, the job creation/execution data, the job list, the job data, and the like.

FIG. 7 shows an example of the job assortment data, FIG. 8 shows an example of the job creation/execution data, FIG. 9 shows an example of the job list, and FIG. 10 shows an example of the job data.

As shown in FIG. 7, the job assortment data D2 includes: a non-assorted job counter D21 indicating a value that is initialized to 0 when a power supply of the image forming apparatus 2 is turned ON, and indicating the counted number of jobs (non-assorted jobs) in which the assortment setting button B2 is not checked and which are executed after the initialization; and a next discharge position D22 indicating the discharge position of the sheets in the case of performing the next assortment. The next discharge position D22 indicates a preset first discharge position as 0, and a preset second discharge position different from the first discharge position as 1.

As shown in FIG. 8, the job creation/execution data D3 includes: a job creation counter D31 indicating a value that is initialized to 0 when the power supply of the image forming apparatus 2 is turned ON, and indicating the counted number of jobs created after the initialization; and a job execution counter D32 indicating a value that is initialized to 0 when the power supply of the image forming apparatus is turned ON, and indicating the counted number of jobs executed after the initialization.

As shown in FIG. 9, the job list R1 includes: data indicating job names which identify the respective received jobs which has not been executed yet; and data indicating addresses in which job data of the respective jobs are stored. Each of the jobs shown in the job list R1 is identified by an offset amount (for example, N+0 in the case of Job 1) shown in parentheses, and is associated with a value N indicated by the job execution counter D32. For example, Job 1 indicates an N-th executed job as a value indicated by the job execution counter D32 from the time when the power supply of the image forming apparatus 2 is turned ON. Hence, a job which has been executed is deleted from the job list R1.

As shown in FIG. 10, the job data 131 comprises: data (page common data 131*a*) common to each of the original pages; and data (individual page data 131*b*), each of which is specific to each of the original pages.

The page common data 131*a* includes data indicating the variety of setting conditions set based on the instruction signals inputted from the operation apparatus 1 and the operation display unit 30, and indicating operation states of an image forming operation and a post-processing operation.

For example, the page common data 131*a* includes: the set number of copies D41; the number of already outputted copies D42; a copy mode D43; a sheet feed tray D44; a post-processing mode D45; assortment D46; an assorted sheet discharge position D47; a print page number D48; the number of already read images D49; a sheet feed counter D50; a sheet discharge counter D51; a last sheet D52; and the like.

The set number of copies D41 indicates the number of sheets to be outputted. The number of already outputted copies D42 indicates a value of counting the number of already outputted copies. The copy mode D43 indicates surfaces on which the image data is to be formed. Specifically, the copy mode D43 indicates that one-sided printing is changed to double-sided printing or the double-sided printing is changed to the one-sided printing. The sheet feed tray D44 indicates the sheet feed tray in which the sheets to be fed are stored.

The post-processing mode D45 indicates a type of the set post processing (for example, whether or not to perform sorting based on whether or not the sort setting button b1 is checked, and the like). The assortment D46 indicates whether or not there is an instruction to switch the discharge position of the sheets in the job itself based on the instruction as to whether or not the assortment setting button B2 is checked. The assorted sheet discharge position D47 indicates the discharge position of the sheets for the job in the case of executing the job assortment processing.

The print page number D48 indicates an identification number of individual image data corresponding to an original page for which the image forming processing is carried out. The number of already read images D49 indicates the total number of the read individual image data. The sheet feed counter D50 indicates the number of fed sheets. The sheet discharge counter D51 indicates the number of discharged sheets. The last sheet D52 indicates that the last sheet in the job has been fed. The last sheet D52 indicates 0 when the last sheet has not been fed yet, and indicates 1 when the last sheet has been fed.

The individual page data includes identification numbers (for example, page 1, page 2 . . . ) assigned to the individual image data corresponding to the respective read original pages, and is stored individually. Each of the individual image data includes: an image storage address D53 indicating an address on the image memory 170 in which the individual image data is stored; the post processing for each of the individual image data; and the like.

The reading processing unit 140 carries out a variety of processing such as analog processing, A/D conversion processing and shading processing for the analog image signal inputted from an image reading control unit 200 of the image reading unit 20, and then creates digital image data. The created image data is outputted to the compression IC 150.

The compression IC 150 carries out compression processing for the inputted digital image data, and outputs the digital image data to the DRAM control IC 160.

In accordance with an instruction from the control unit 110, the DRAM control IC 160 controls the compression processing for the image data by the compression IC 150 and decompression processing for the compressed image data by the decompression IC 180. Moreover, the DRAM control IC 160 controls an input/output of the image data for the image memory 170. For example, when an instruction to store the image signal read by the image reading unit 20 is received, the DRAM control IC 160 allows the compression IC 150 to execute the compression processing for the image data inputted from the reading processing unit 140, and to store the compressed image data in a compression memory 171 of the image memory 170. Moreover, when an instruction to print out the compressed image data stored in the compression memory 171 is received, the DRAM control IC 160 reads out the compressed image data from the compression memory 171, and allows the decompression IC 180 to implement the decompression processing for the compressed image data, and to store the decompressed image data in a page memory 172. Furthermore, when an instruction to print out the image data stored in the page memory 172 is received, the DRAM control IC 160 reads out the image data from the page memory 172, and outputs the image data to the write processing unit 190.

The image memory 170 includes: the compression memory 171; and the page memory 172, each of which comprises a dynamic RAM (DRAM). The compression memory 171 is a memory for storing the compressed image data. The page memory 172 is a memory for temporarily storing the image data to be printed out.

The decompression IC 180 implements the decompression processing for the inputted compressed image data.

Based on the image data inputted from the DRAM control IC 160, the write processing unit 190 creates print data for the image forming, and outputs the print data to the printing unit 40.

The image reading unit 20 comprises: the CCD 22*a*, the image reading control unit 200, and further comprises the automatic original feed unit 21 and the reading unit 22, which are shown in FIG. 4 (not shown in FIG. 10). The image reading control unit 200 controls the automatic original feed unit 21, the reading unit 22 and the like to execute exposure scanning for a surface of the original, and allows the CCD 22*a* to perform photoelectric conversion for reflected light. Therefore, the image is read. The read analog image signal is outputted to the reading processing unit 140.

The operation display unit 30 comprises a liquid crystal display (LCD) 31 and an operation display control unit 300 and further comprises an operation key group (not shown). A touch panel is provided on the LCD 31 so as to cover the LCD 31. In accordance with the display signals inputted from the control unit 110, the operation display control unit 300 allows the LCD 31 to display the variety of setting screens for inputting the variety of setting conditions, the results of the variety of processing, and the like. Moreover, the operation display control unit 300 outputs an operation signal which is inputted from the operation key group or the touch panel, to the control unit 110.

Moreover, on the LCD 31 of the operation display unit 30, a copier/printer setting screen for setting a variety of operations in the case of executing the copying and the printing is displayed.

Figure 11:
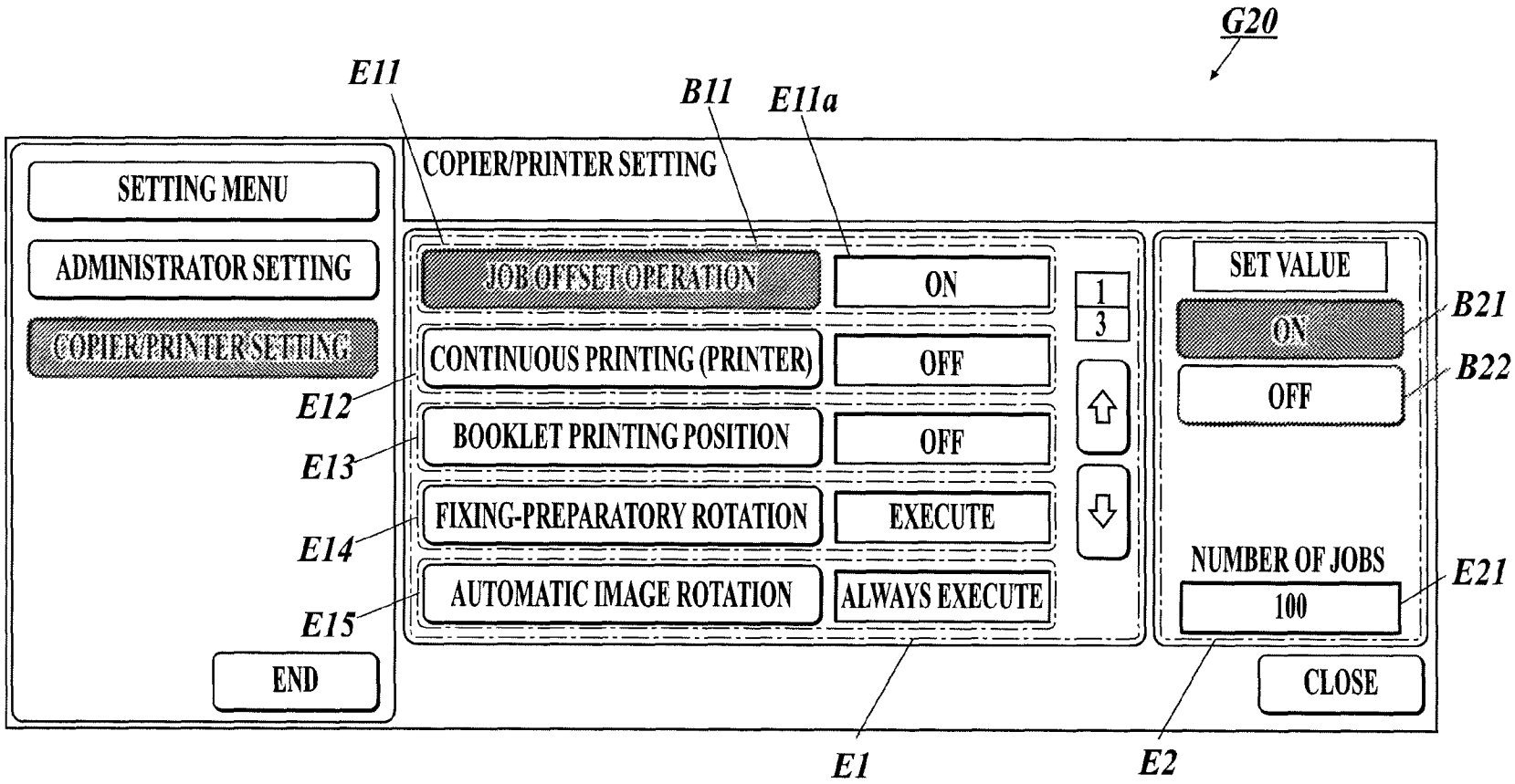
FIG. 11 is a view showing an example of a copy/printer setting screen.

FIG. 11 shows an example of the copier/printer setting screen G20.

As shown in FIG. 11, the copier/printer setting screen G20 includes: a setting item selection area E1 having a job offset operation setting area E11, a continuous printing setting area E12, a booklet printing position setting area E13, a fixing-preparatory rotation setting area E14, an automatic image rotation setting area E15, and the like; and a setting area E2 that receives instructions relating to the variety of setting conditions for the items selected in the setting item selection area E1.

The job offset operation setting area E11 includes: a job offset operation button B11 that receives the setting for the job assortment processing in this embodiment; and a display area E11*a* on which the condition set in the setting area E2 is displayed.

The setting area E2 includes: an ON button B21 and an OFF button B22, which receive an instruction as to whether or not to execute the job assortment processing when the job offset operation button B11 is depressed; and a number-of-jobs setting area E21 that becomes effective when the ON button B21 is depressed, and receives an instruction on the number of jobs from a ten key (not shown) or the like of the operation display unit 30.

Specifically, the ON button 21 and the OFF button B22, which are displayed on the setting area E2 when the job offset operation button B11 is depressed, function as a first input unit that receives the instruction to switch the discharge position of the sheets per the number of jobs, and the number-of-jobs setting area E21 functions as a second input unit that receives the instruction for the number of jobs.

The printing unit 40 includes: the image forming unit 43 and the like, which are shown in FIG. 4; and the print control unit 400. The print control unit 400 controls the operations of each unit such as the image forming unit 43 of the printing unit 40 in accordance with instructions from the control unit 110, and allows each unit to form the image on the sheets P based on the print data inputted from the write processing unit 190. In addition, the printing unit 40 outputs instruction signals for operating each unit of the post-processing unit 50, to the post-processing control unit 500 in accordance with an instruction from the control unit 110.

Next, a description will be made of each unit of the printer controller 2*b*. The printer controller 2*b* is one that manages and controls the job which is inputted to the image forming apparatus 2 from the operation apparatus 1 connected to the network 3, in the case of using the image forming apparatus 2 as a network printer. The printer controller 2*b* receives the data for printing from the operation apparatus 1, and transmits the data to the body unit 2*a*.

The printer controller 2*b* comprises: a controller control unit 21*b*; a DRAM control IC 22*b*; an image memory 23*b*; and the LANIF 24*b*.

The controller control unit 21*b* controls the operations of each unit of the printer controller 2*b* in a comprehensive manner, and transmits the data which is inputted from the operation apparatus 1 through the LANIF 24*b*, as the job to the body unit 2*a*.

The DRAM control IC 22*b* controls the storing of the data which is received by the LANIF 24*b*, in the image memory 23*b*, and controls the reading out of the data from the image memory 23*b*. Moreover, the DRAM control IC 22*b* is connected to the DRAM control IC 160 of the control board 100 by a peripheral components interconnect (PCI) bus. In accordance with an instruction from the controller control unit 21*b*, the DRAM control IC 22*b* reads out the data for printing from the image memory 23*b*, and outputs the data to the DRAM control IC 160.

The image memory 23*b* includes a DRAM, and temporarily stores the received output data.

The LANIF 24*b* is a communication interface, such as the network interface card (NIC) and the modem, for connecting to the network 3 such as the LAN. The LANIF 24*b* receives the data from the operation apparatus 1. The received data is outputted to the DRAM control IC 22*b*.

The post-processing unit 50 includes: the offset unit 51; a sorting unit, and a conveyor unit such as conveyor rollers which convey the sheets, and is controlled by the post-processing control unit 500 in a comprehensive manner. In response to an instruction signal relating to the post processing, which is inputted from the control unit 110 through the print control unit 400, the post-processing control unit 500 conveys the sheets P to a predetermined unit along a conveyor passage, controls each unit to perform predetermined post processing for the sheets P, and discharges the processed sheets P to a predetermined discharge position of the sheet discharge tray.

Next, a description will be made of the operations of this embodiment.

FIGS. 12 to 18 show flowcharts of the job assortment processing in this embodiment. The flowcharts shown in FIGS. 12 to 18 indicate the processing executed by the control unit 110.

Figure 12:
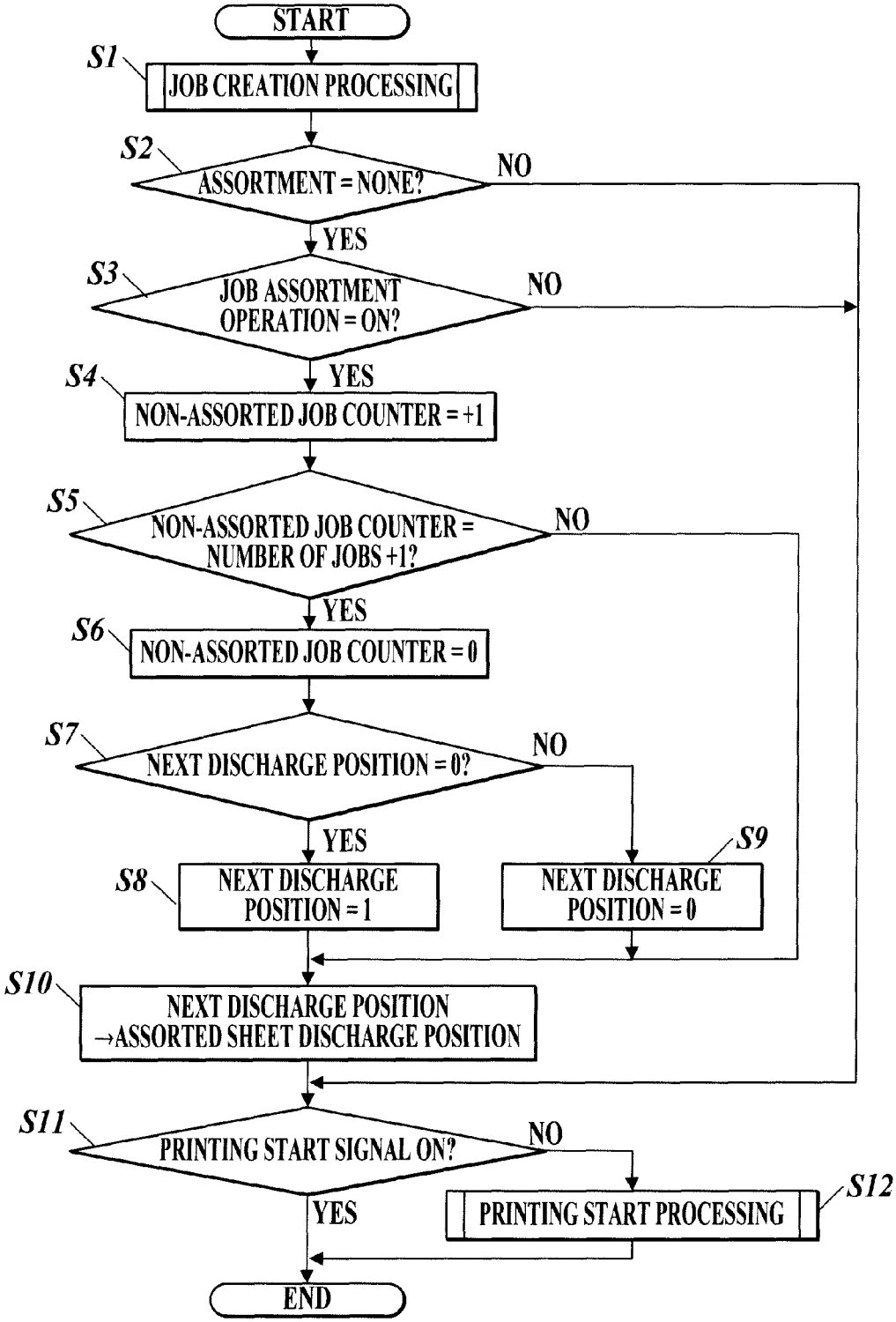
FIG. 12 is a flowchart showing processing in which a control unit executes an instruction to start to execute one job every time of receiving the instruction from a printer controller.

FIG. 12 shows the processing which the control unit 110 executes every time of receiving the instruction to start to execute one job, from the printer controller 2*b*.

First, when the variety of setting conditions and the image data are inputted to the operation apparatus 1 or the operation display unit 30, the control unit 110 executes job creation processing (refer to FIG. 13) for creating the job data based on the variety of inputted setting conditions and the inputted image data, and storing the job data in the RAM 130 (Step S1). Then, the control unit 110 refers to a job data storage address of a job name having an offset amount corresponding to a value M indicated by the job creation counter D31, reads out job data of the job name, and determines whether or not the assortment D46 of the readout job data is set to be none (STEP S2).

When the assortment D46 is set to be none (Step S2: Yes), it is determined whether or not the job assortment operation D11 of the job assortment setting data D1 is set to be ON (Step S3). When the job assortment operation D11 is set to be ON (Step S3: Yes), 1 is added to the non-assorted job counter D21 (Step S4).

When the assortment D46 is not set to be none (Step S2: No), or when the job assortment operation D11 is not set to be ON (Step S3: No), the control unit 110 proceeds to Step S11.

The control unit 110 determines whether or not the value indicated by the non-assorted job counter D21 is equal to a value obtained by adding 1 to the value indicated by the number of jobs D12 (Step 5). When both of the values are not equal to each other (Step S5: No), the control unit 110 proceeds to Step S10.

When the value indicated by the non-assorted job counter D21 is equal to the value obtained by adding 1 to the value indicated by the number of jobs D12 (Step S5: Yes), the control unit 110 initializes the non-assorted job counter D21 to 0 (Step S6), and determines whether or not the next discharge position D22 is set at 0 (Step S7).

When the next discharge position D22 is set at 0 (Step S7: Yes), the control unit 110 sets the next discharge position to 1 (Step S8). When the next discharge position D22 is not set at 0, that is, when the next discharge position D22 is set to 1 (Step S7: No), the control unit 110 sets the next discharge position D22 at 0 (Step S9).

After Step S8 or Step S9, the control unit 110 sets the value which is set in the next discharge position D22, to the assorted sheet discharge position D47 (Step S10). Then, the control unit 110 determines whether or not a printing start signal is ON by inputting the instruction to start the printing in the operation apparatus 1 or the operation display unit 30 (Step S11). When the printing start signal is ON (Step S11: Yes), the control unit 110 ends this processing. When the printing start signal is not ON (Step S11: No), the control unit 110 executes printing start processing (refer to FIG. 14) to be described later (Step S12), and ends this processing.

Figure 13:
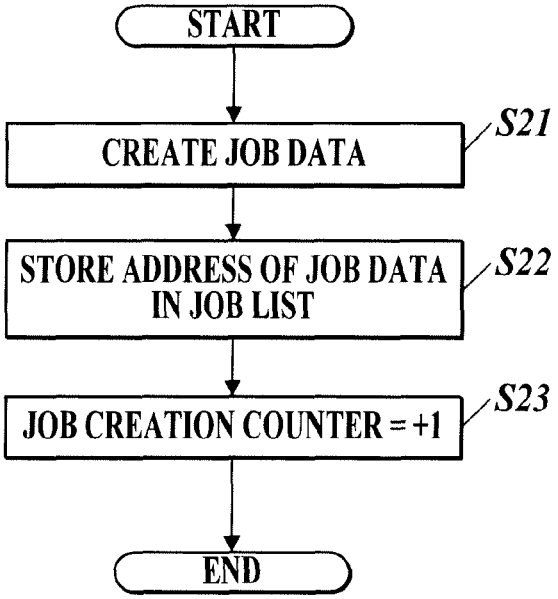
FIG. 13 is a flowchart of job creation processing.

FIG. 13 shows a flowchart of the job creation processing executed in Step S1.

The control unit 110 creates the job data based on the variety of setting conditions and the image data, which are inputted from the operation apparatus 1 and the operation display unit 30, and stores the created job data in the RAM 130 (Step S21).

In the job list R1, the control unit 110 stores the address in which the created job data is stored, in the job data storage address of the job name having the offset amount corresponding to the value M indicated by the job creation counter D31 (Step S22). Then, the control unit 110 adds 1 to the job creation counter (Step S23), and ends this processing.

Figure 14:
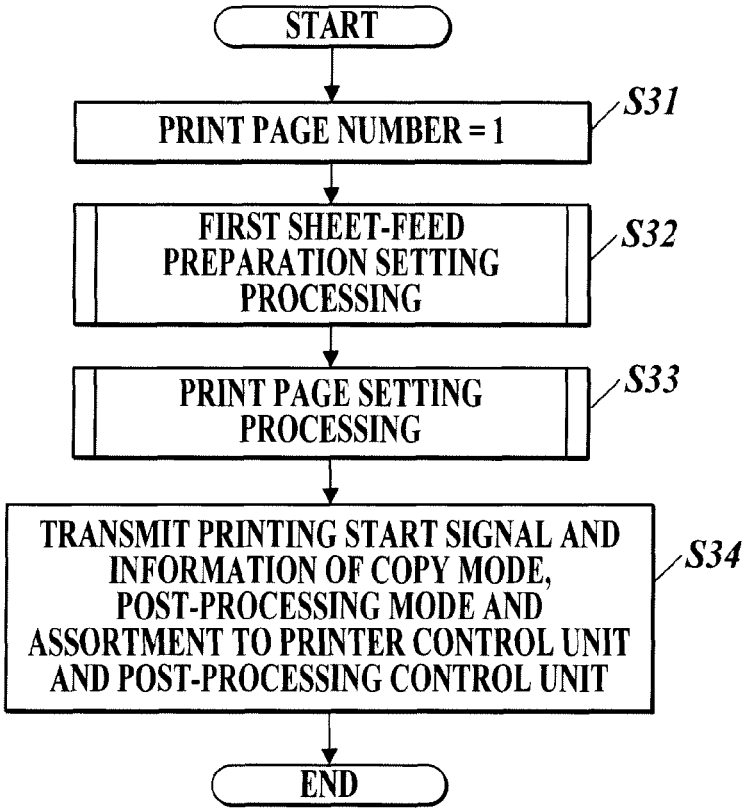
FIG. 14 is a flowchart of printing start processing.

FIG. 14 shows a flowchart of the printing start processing executed in Step S12.

The control unit 110 refers to a job data storage address of a job name having an offset amount corresponding to a value N indicated by the job execution counter D32, reads out job data of the job name, and sets the print page number D48 of the readout job data to 1 (Step S31).

The control unit 110 executes first sheet-feed preparation setting processing (refer to FIG. 15) to be described later (Step S32). After the first sheet-feed preparation setting, the control unit 110 executes print page setting processing (refer to FIG. 16) to be described later (Step S33).

After the print page setting processing (after Step S33), the control unit 110 transmits the copy mode D43, the post-processing mode D45 and the assortment D46 of the job data read out in Step S31, together with the printing start signal, to the print control unit 400 and the post-processing control unit 500 (Step S34), and ends this processing.

Figure 15:
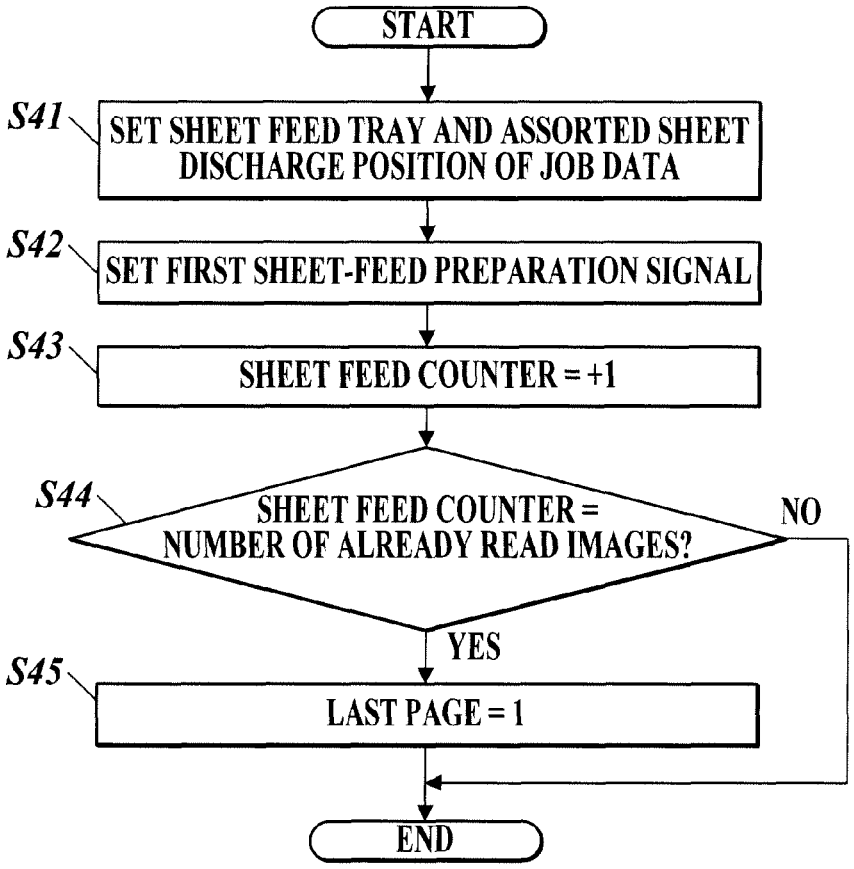
FIG. 15 is a flowchart of first sheet-feed preparation setting processing.

FIG. 15 shows a flowchart of the first sheet-feed preparation setting processing executed in Step S32. The first sheet-feed preparation setting processing is processing for setting the tray in which the sheets to be fed are stored, the discharge position of the sheets after the sheets are discharged, information relating to print page data for the sheets to be fed, and the like when the sheet feed unit 41 feeds the sheets.

The control unit 110 refers to the job data storage address of the job name having the offset amount corresponding to the value N indicated by the job execution counter D32, reads out the job data of the job name, and sets a sheet feed tray which is indicated by the sheet feed tray D44 of the job data, as the sheet feed tray that feeds the sheets, and sets a discharge position which is indicated by the assorted sheet discharge position D47, as the discharge position of the sheets after the sheets are discharged (Step S41).

The control unit 110 sets the set sheet feed tray and the set discharge position as a first sheet-feed preparation signal (Step S42). Then, the control unit 110 adds 1 to the sheet feed counter D50 of the readout job data (Step S43).

The control unit 110 determines whether or not the value indicated by the sheet feed counter D50 of the readout job data is equal to the value indicated by the number of already read images D49 (Step S44). When both of the values are not equal to each other (Step S44: No), the control unit 110 ends this processing.

When the value indicated by the sheet feed counter D50 of the readout job data is equal to the value indicated by the number of already read images D49 (Step S44: Yes), the control unit 110 sets the last sheet D52 of the readout job data to 1 (Step S45), and ends this processing.

Figure 16:
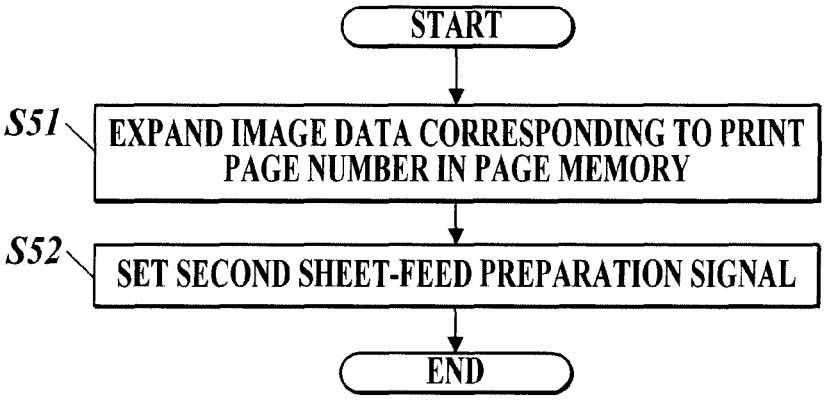
FIG. 16 is a flowchart of print page setting processing.

FIG. 16 shows a flowchart of the print page setting processing executed in Step S33. The print page setting processing is processing for creating and setting the print page data in response to the job data in which the individual image data corresponding to each original page is set.

The control unit 110 refers to the job data storage address of the job name having the offset amount corresponding to the value N indicated by the job execution counter D32, reads out the job data of the job name, and expands the individual image data stored in the image storage address D53, which corresponds to the identification number of the original page, which is indicated by the print page number D48 of the job data, in the page memory 172 (Step S51).

The control unit 110 sets the image data which is expanded in the page memory 172, as the print page data, sets the above setting as a second sheet-feed preparation signal (Step S52), and ends this processing.

Figure 17:
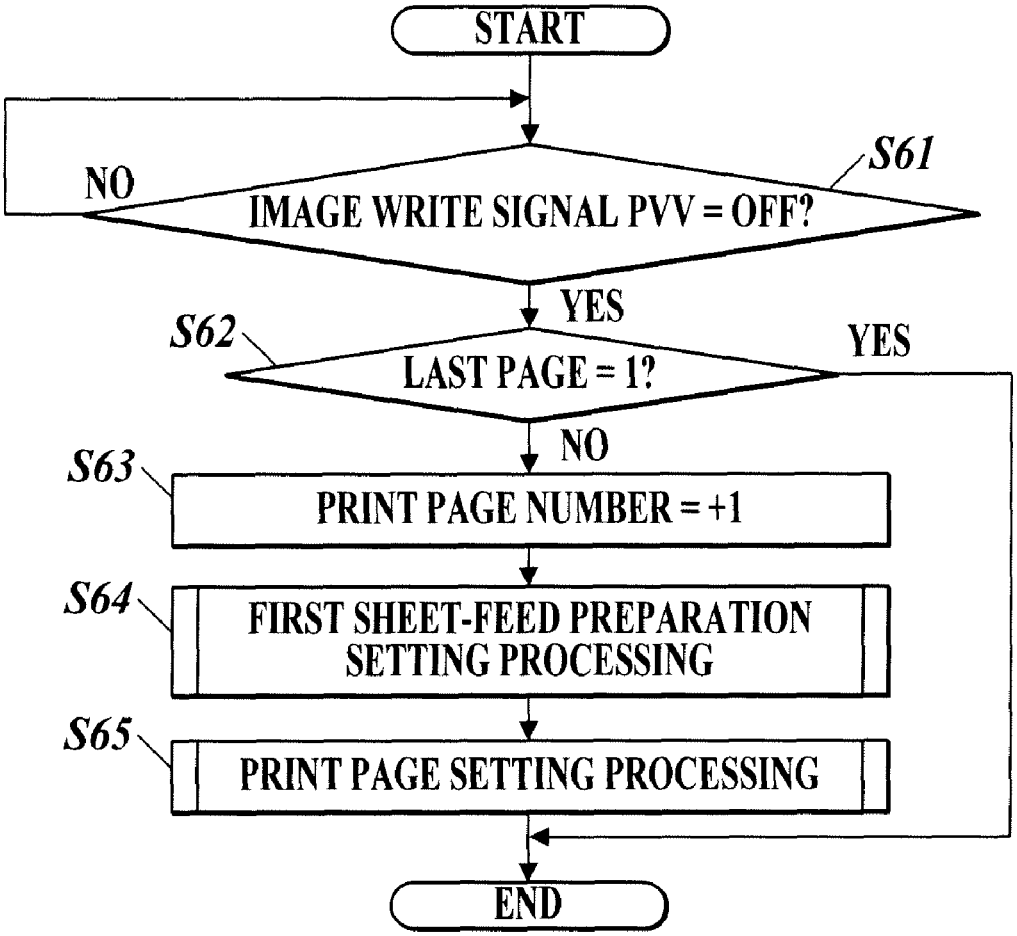
FIG. 17 is a flowchart of processing to be executed when an image write signal is switched from an ON state to an OFF state.

FIG. 17 shows a flowchart of processing executed when the image write signal PVV is switched from the ON state to the OFF state after the image forming processing is started.

First, the control unit 110 determines whether or not the image write signal PVV is switched from the ON state to the OFF state (Step S61). When the image write signal PVV is not switched to the OFF state (Step S61: No), the first control unit 110 waits until the image write signal PVV is switched to the OFF state.

When the image write signal PVV is switched to the OFF state (Step S61: Yes), the control unit 110 refers to the job data storage address of the job name having the offset amount corresponding to the value N indicated by the job execution counter D32, reads out the job data of the job name, and determines whether or not the last sheet D52 of the job data is set to 1 (Step S62). When the last sheet D52 is set to 1 (Step S62: Yes), the control unit 110 ends this processing.

When the last sheet D52 of the readout job data is not set to 1, that is, when the last sheet D52 is 0 (Step S62: No), the control unit 110 adds 1 to the print page number D48 (Step S63). Then, the control unit 110 executes the above-mentioned first sheet-feed preparation setting processing (refer to FIG. 15) (Step S64). After the first sheet-feed preparation setting processing, the control unit 110 executes the above-mentioned print page setting processing (refer to FIG. 16) (Step S65), and ends this processing.

Figure 18:
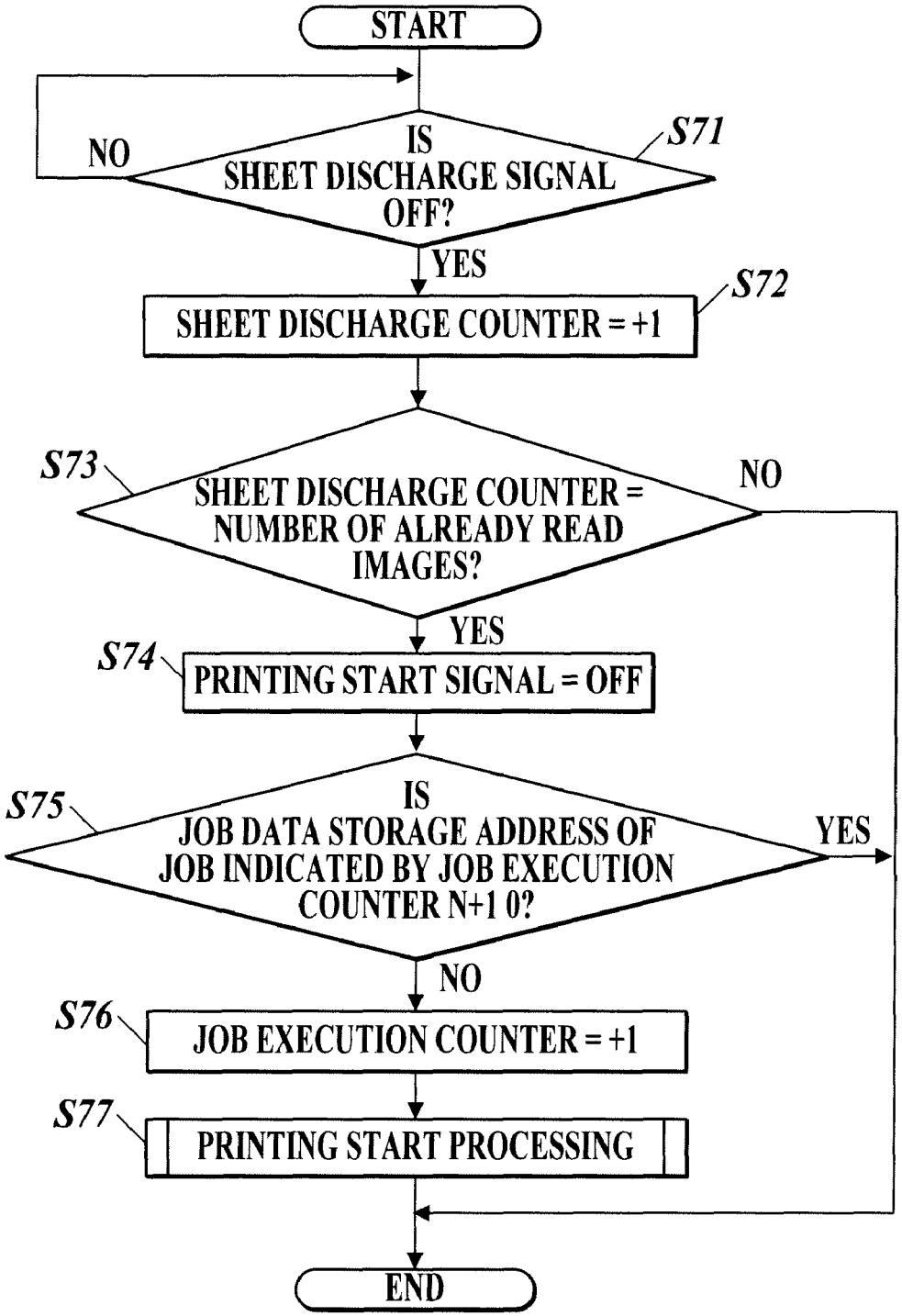
FIG. 18 is a flowchart of processing to be executed when a sheet discharge signal inputted from a post-processing control unit through a print control unit to the control unit is switched from an ON state to an OFF state.

FIG. 18 shows a flowchart of processing executed when a sheet discharge signal inputted from the post-processing control unit 500 through the print control unit 400 to the control unit 110 is switched from an ON state to an OFF state.

First, the control unit 110 determines whether or not the sheet discharge signal is switched from the ON state to the OFF state (Step S61). When the sheet discharge signal is not switched to the OFF state (Step S71: No), the control unit 110 waits until the sheet discharge signal is switched to the OFF state.

When the sheet discharge signal is switched to the OFF state (Step S71: Yes), the control unit 110 refers to the job data storage address of the job name having the offset amount corresponding to the value N indicated by the job execution counter D32, reads out the job data of the job name, and adds 1 to the sheet discharge counter D51 of the job data (Step S72).

After Step S72, the control unit 110 determines whether or not the value indicated by the sheet discharge counter D51 of the readout job data is equal to the value indicated by the number of already read images D49 (Step S73). When both of the values are not equal to each other (Step S73: No), the control unit 110 ends this processing.

When the value indicated by the sheet discharge counter D51 of the readout job data is equal to the value indicated by the number of already read images D49 (Step S73: Yes), the control unit 110 sets the printing start signal to OFF (Step S74).

The control unit 110 refers to a job data storage address of a job name having an offset amount corresponding to a value obtained by adding 1 to the value N indicated by the job execution counter D32, and determines whether or not the job data storage address is 0, that is, whether or not an address in which the job data is stored is not stored in the jot data storage address (Step S75).

When the job data storage address of the job name having the offset amount corresponding to the value obtained by adding 1 to the value N indicated by the job execution counter D32 is 0, that is, when the address in which the job data is stored is not stored (Step S75: Yes), the control unit 110 determines that there is no unexecuted job in the job list R1, and ends this processing.

When the job data storage address is not 0, that is, when the address in which the job data is stored is stored (Step S75: No), the control unit 110 determines that there is an unexecuted job in the job list R1, and adds 1 to the job execution counter D32 (Step S76). Then, the control unit 110 executes the above-mentioned printing start processing (refer to FIG. 14) (Step S77), and ends this processing.

Figure 19A:
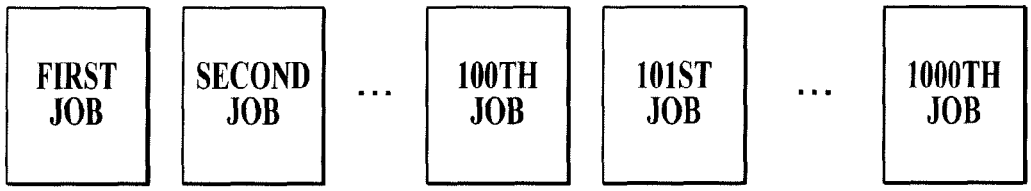
FIGS. 19A and 19B are concept illustrations of job assortment processing.
Figure 19B:
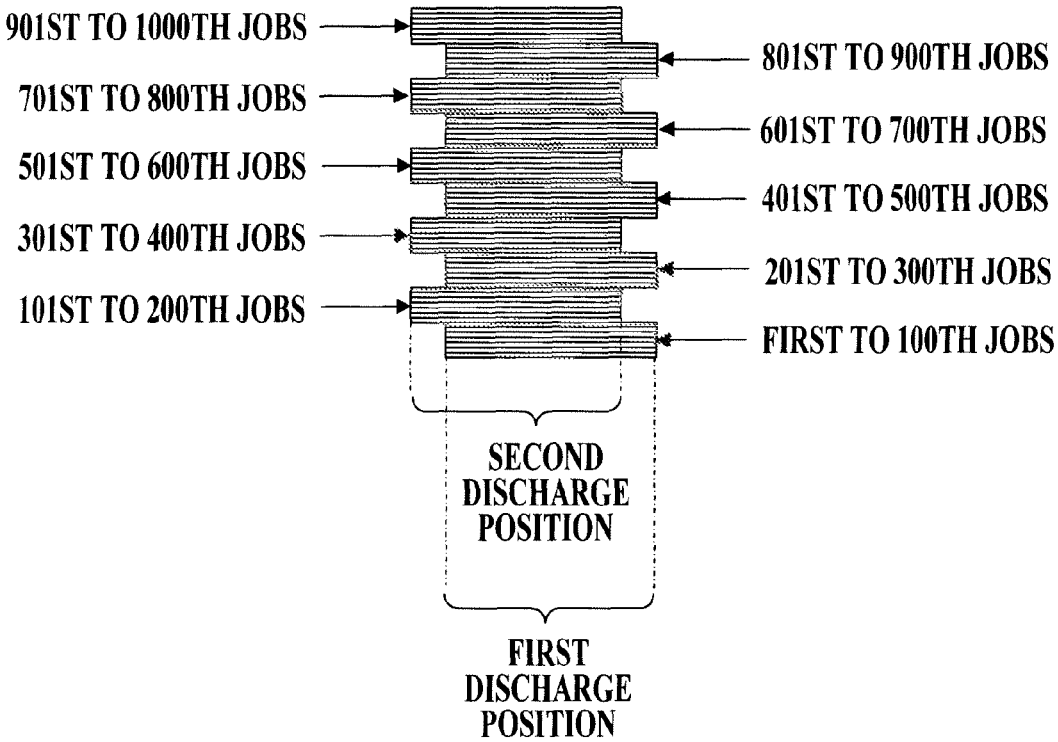
Figure 20:
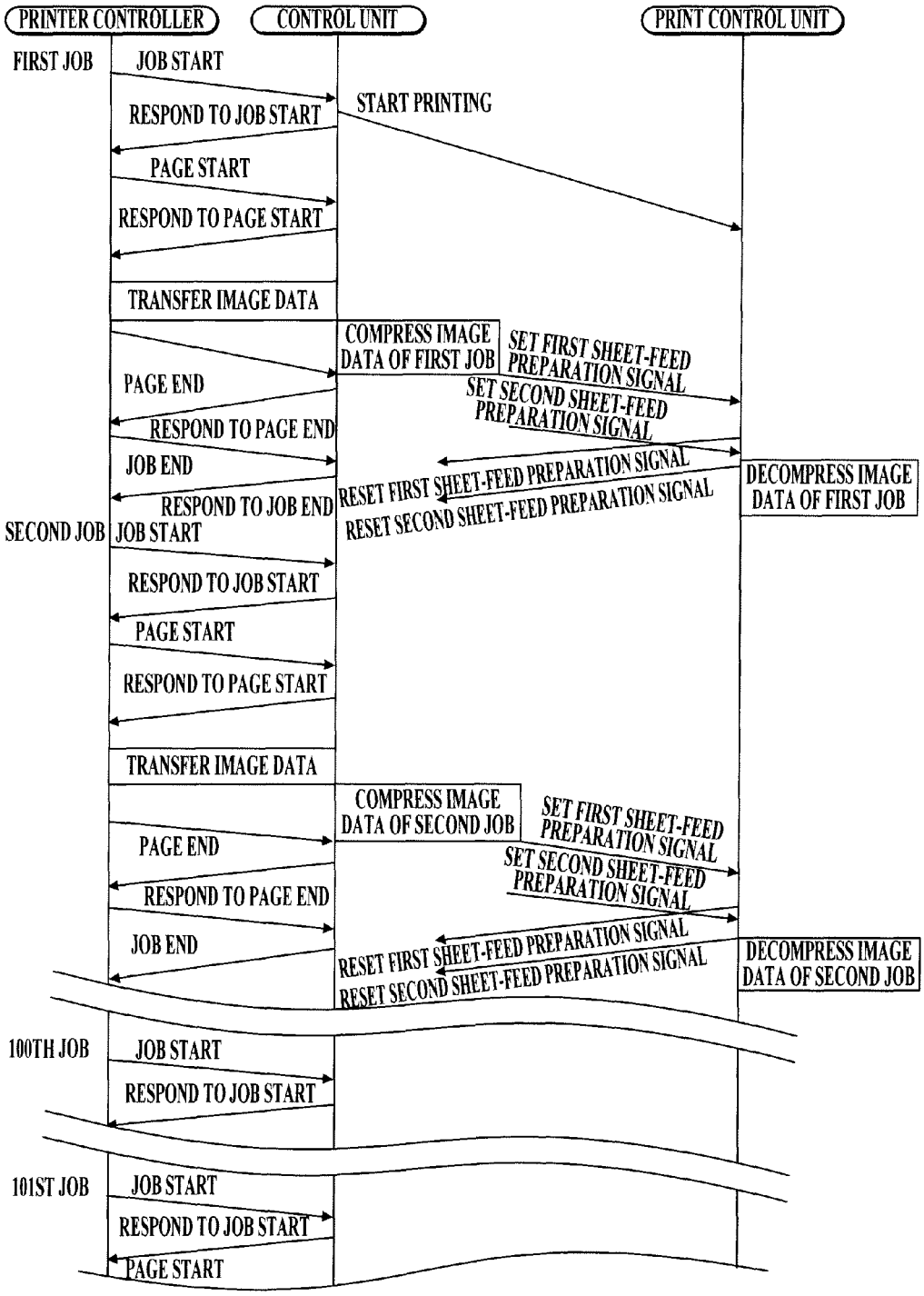
FIG. 20 is an example of a ladder diagram showing the operations of the image forming apparatus, which realize the job assortment processing of FIGS. 19A and 19B.
Figure 21:
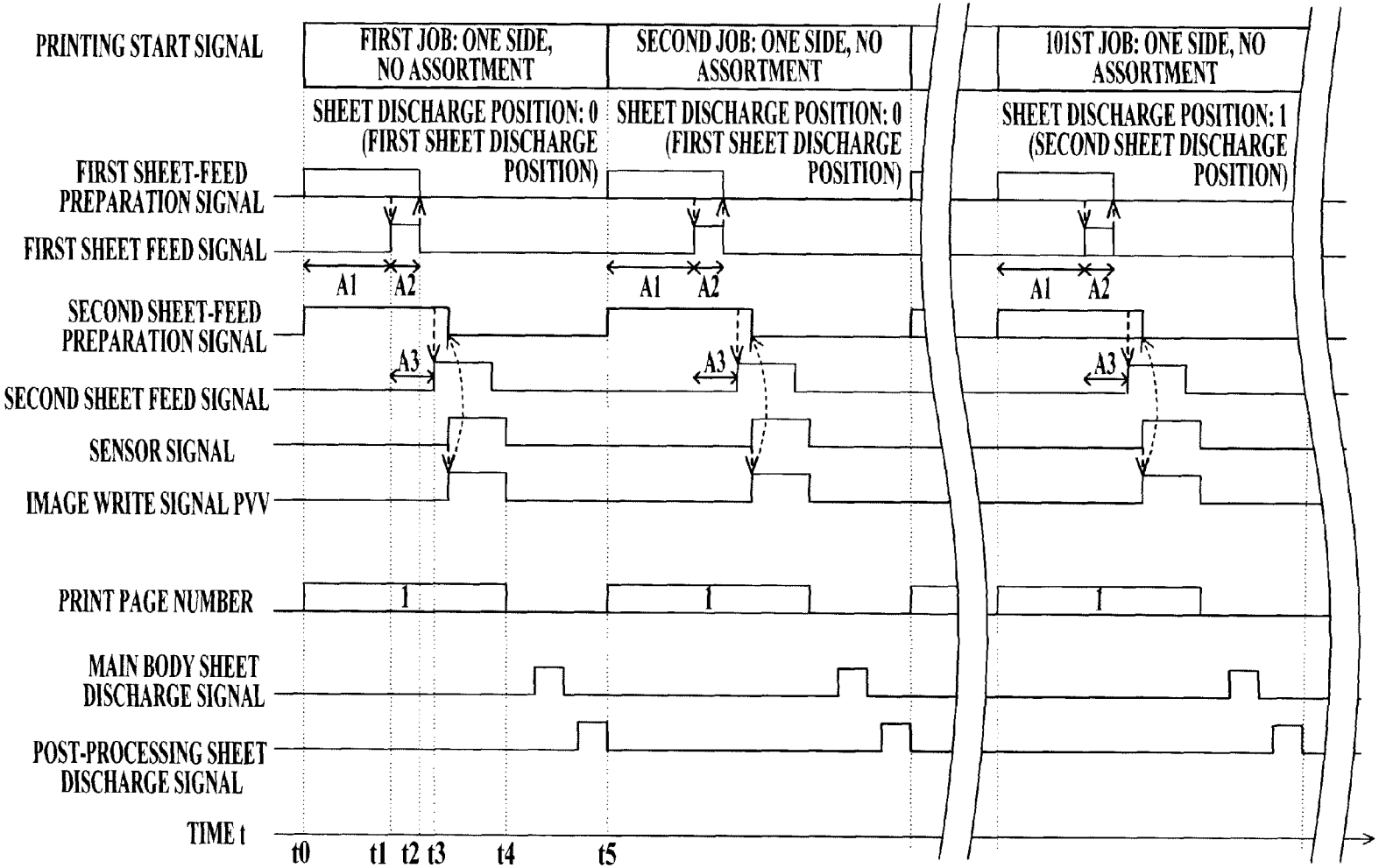
FIG. 21 is an example of a time chart showing the operations of the image forming apparatus, which realize the job assortment processing of FIGS. 19A and 19B.

FIGS. 19A and 19B show concept illustrations of the job assortment processing executed in the embodiment. FIG. 20 shows an example of a ladder diagram showing operations of the image forming apparatus 2, which realize the job assortment processing of FIGS. 19A and 19B. FIG. 21 shows an example of a time chart showing the operations of the image forming apparatus 2, which realize the job assortment processing of FIGS. 19A and 19B.

FIG. 19A to FIG. 21 show an example of the case of discharging the sheets to different discharge positions per 100 jobs when 1000 jobs, each of which has page data in which the one-sided printing and the non-assortment are set, are executed.

FIG. 19A shows a concept of the sheets of the respective jobs, which are discharged from the body unit of the image forming apparatus 2 to the post-processing unit 50. FIG. 19B shows a concept of the sheets of the respective jobs, which are discharged to and stacked on the sheet discharge tray T3.

As shown in FIG. 19A, one sheet is discharged for each job since the page data of each job is one, and accordingly, when 1000 jobs (first to 1000th jobs) are executed, 1000 sheets are discharged to the post-processing unit 50.

As shown in FIG. 19B, the sheets of the respective jobs, which are discharged to and stacked on the sheet discharge tray T3, are stacked on the different positions by every 100 jobs, in this case, by every 100 sheets since one sheet is discharged when one job is executed.

For example, sheets discharged by executing the first to 100th jobs are discharged to the first discharge position, and sheets discharged by executing the 101st to 200th jobs are discharged to the second discharge position. Then, the sheets are discharged while the discharge position thereof is switched alternately to the first discharge position and the second discharge position per 100 jobs.

Next, by taking the case of FIG. 19A and FIG. 19B as an example, a description will be made of the example of the ladder diagram showing the operations of the image forming apparatus 2, which is shown in FIG. 20.

First, when the instruction to start to execute the first job (to start the job) is received from the printer controller 2*b*, the control unit 110 executes the processing shown in FIG. 12. By the processing shown in FIG. 12, the job creation processing shown in FIG. 13 is executed, and the job data of the first job is created and stored in the RAM 130. Moreover, in the job list R1, an address in which the created job data is stored, is stored in a job data storage address of a job name having an offset amount corresponding to the value M (M=0) indicated by the job creation counter D31. Then, 1 is added to the job creation counter D31 (D31=1). Here, since the value N indicated by the job execution counter D32 is 0, the offset amount (N+0) of Job 1 becomes 0, and the address of the created job data of the first job is stored in the job data storage address corresponding to Job 1.

Then, it is determined whether or not the assortment D46 of the created job data of the first job is set to be none, and it is determined whether or not the job assortment operation D11 is set to be ON. In the example shown in FIGS. 19A and 19B, the assortment D46 of the job data of the first job is set to be none, and the job assortment operation D11 is set to be ON, and accordingly, 1 is added to the non-assorted job counter D21 (D21=1). Then, it is determined whether or not the value indicated by the non-assorted job counter D21 is equal to the value (101) obtained by adding 1 to the value (100) indicated by the number of jobs D12. The value (D21=1) indicated by the non-assorted job counter D21 is not equal to the value (101) obtained by adding 1 to the value indicated by the number of jobs D12. Accordingly, the value (D22=0) set in the next discharge position D22 is set in the assorted sheet discharge position D47 of the job data (D47=0).

Then, it is determined whether or not the printing start signal is ON. When the instruction to start the first job is received, the printing start signal is not ON. Accordingly, the printing start processing shown in FIG. 14 is executed at a time T0 shown in FIG. 21.

Next, when the control unit 110 receives an instruction to start the second job from the printer controller 2*b*, the job creation processing shown in FIG. 13 is executed by the processing shown in FIG. 12, and the job data of the second job is created and stored in the RAM 130. Moreover, in the job list R1, an address in which the created job data is stored, is stored in a job data storage address of a job name having an offset amount corresponding to the value M (M=1) indicated by the job creation counter D31. Then, 1 is added to the job creation counter D31 (D31=2).

Then, it is determined whether or not the assortment D46 of the created job data of the second job is set to be none, and moreover, it is determined whether or not the job assortment operation D11 is set to be ON. In the example shown in FIGS. 19A and 19B, the assortment D46 of the job data of the second job is set to be none, and the job assortment operation D11 is set to be ON. Accordingly, 1 is added to the non-assorted job counter D21 (D21=2). Then, it is determined whether or not the value indicated by the non-assorted job counter D21 is equal to the value (101) obtained by adding 1 to the value (100) indicated by the number of jobs D12. The value (D21=2) indicated by the non-assorted job counter D21 is not equal to the value (101) obtained by adding 1 to the value indicated by the number of jobs D12. Accordingly, the value (D22=0) set in the next discharge position D22 is set in the assorted sheet discharge position D47 of the job data (D47=0).

Then, it is determined whether or not the printing start signal is ON. When the instruction to start the second job is received, the printing start signal is ON. Accordingly, this processing is ended.

Thereafter, the control unit 110 executes the above-described processing shown in FIG. 12 in a similar way to the second job every time of receiving the instruction to start each of the third to 100th jobs.

When the control unit 110 receives an instruction to start a 101st job from the printer controller 2*b* after creating the job data of jobs, the number of which is the value (D12=100) indicated by the number of jobs D12, the job creation processing shown in FIG. 13 is executed by the processing shown in FIG. 12, and job data of the 101st job is created and stored in the RAM 130. Moreover, in the job list R1, an address in which the created job data is stored, is stored in a job data storage address of a job name having an offset amount corresponding to the value M (M=100) indicated by the job creation counter D31. Then, 1 is added to the job creation counter D31 (D31=101).

Then, it is determined whether or not the assortment D46 of the created job data of the first job is set to be none, and moreover, it is determined whether on not the job assortment operation D11 is set to be ON. In the example shown in FIGS. 19A and 19B, the assortment D46 of the job data of the 101st job is set to be none, and the job assortment operation D11 is set to be ON. Accordingly, 1 is added to the non-assorted job counter D21 (D21=101). Then, it is determined whether or not the value indicated by the non-assorted job counter D21 is equal to the value (101) obtained by adding 1 to the value (100) indicated by the number of jobs D12. The value (D21=101) indicated by the non-assorted job counter D21 is equal to the value (101) obtained by adding 1 to the value indicated by the number of jobs D12. Accordingly, it is determined whether or not the value (D22=0) set in the next discharge position D22 is 0. Here, the value set in the next discharge position D22 is 0, and accordingly, the next discharge position D22 is set to 1. Then, the value (D22=1) set in the next discharge position is set in the assorted sheet discharge position D47 of the job data (D47=1).

Then, it is determined whether or not the printing start signal is ON. When the instruction to start the 101st job is received, the printing start signal is ON. Accordingly, this processing is ended.

Hence, when the instruction to start the job is newly received after creating the job data of jobs, the number of which is the value (D12=100) indicated by the number of jobs D12, the control unit 100 switches the next discharge position. In such a way, the setting for switching the discharge position per 100 jobs is performed.

Next, by taking the case of FIG. 19A and FIG. 19B as an example, a description will be made of the example of the time chart showing the operations of the image forming apparatus 2, which is shown in FIG. 21.

The printing start signal is a signal indicating the start of the job execution, and is a signal outputted from the control unit 110 to the print control unit 400 and the post-processing control unit 500 with the operation mode (for example, one-sided printing and non-assortment) of the job.

The first sheet-feed preparation signal is data including the information relating to the set print page data, for example, data including the tray in which the sheets to be fed are stored, information relating to the last sheet, information relating to the discharge position, and the like. The data is outputted from the control unit 110 to the print control unit 400, and to the post-processing control unit 500 through the print control unit 400.

A first sheet feed signal is an operation signal that allows the sheets P to be conveyed from the sheet feed tray 41*a* to the resist rollers 42*a*. An ON state of the first sheet feed signal indicates that a conveying operation is in progress, and the first sheet feed signal is outputted from the print control unit 400 to the control unit 110 in response to the first sheet-feed preparation signal. The first sheet feed signal is turned ON after elapse of a predetermined time after a second sheet feed signal is turned ON (however, except for the time of feeding the first sheet). The predetermined time differs depending on the sheet feed trays.

The second sheet-feed preparation signal is a signal indicating whether or not a write operation of the print page data is possible. An ON state of the second sheet-feed preparation signal indicates a state where write preparation for an image to be written next is completed, and an OFF state thereof indicates that a state where the write preparation is in progress. The second sheet-feed preparation signal is outputted from the control unit 110 to the print control unit 400.

The second sheet feed signal is an operation signal that allows the sheets to be fed from the resist rollers 42*a* to the transferring device 43*a*. An ON state of the second sheet feed signal indicates that the conveying operation is in progress, and the second sheet feed signal is outputted from the print control unit 400 to the control unit 110 in response to the second sheet-feed preparation signal. The second sheet feed signal is turned ON after elapse of a predetermined time after the first sheet feed signal is turned ON.

A sensor signal is turned ON when a tip end of a sheet is detected by a sensor 42*b* provided on the conveyor passage through which the sheets are conveyed from the resist rollers 42*a* to the transferring device 43*a*, and is turned OFF when a terminal end of a sheet is detected.

The image write signal PVV is turned ON when the sensor signal is turned ON, and the image writing is started. The image write signal PVV is turned OFF when the writing of the set print page data for one page is ended. When the image write signal PVV is turned OFF, the first sheet-feed preparation signal and the second sheet-feed preparation signal are turned ON.

A main body sheet discharge signal is an operation signal that allows the sheets, on which the image is formed, to be discharged from the printing unit 40 to the post-processing unit 50. An ON state of the main body sheet discharge signal indicates that a discharge operation is in progress, and the main body sheet discharge signal is outputted from the print control unit 400 to the post-processing control unit 500.

The sheet discharge signal is an operation signal that allows the sheets to be discharged to the sheet discharge tray T3, and is a signal that drives the offset unit 51 to discharge the sheets to the set discharge position. An ON state of the sheet discharge signal indicates that a discharge operation is in progress, and the switching of the sheet discharge signal from the ON state to an OFF state indicates the end of the job execution. Then, the sheet discharge signal is outputted from the post-processing control unit 500 through the print control unit 400 to the control unit 110.

At a time t0, the printing start processing shown in FIG. 14 is executed since the printing start signal is not ON in the processing shown in FIG. 12. Here, as the job name having the offset amount corresponding to the value N (N=0) indicated by the job execution counter D32, the job data storage address of Job 1 is referred to, the job data of Job 1 is read out, and the print page number D48 of the readout job data is set to 1 (D48=1).

Then, the first sheet-feed preparation setting shown in FIG. 15 is executed, and the sheet feed tray indicated by the sheet feed tray D44 of the readout job data, and the discharge position (D47=0: first discharge position) indicated by the assorted sheet discharge position D47, are set. Then, the information relating to the set sheet feed tray and discharge position is set as the first sheet-feed preparation signal. Moreover, 1 is added to the sheet feed counter D50 of the readout job data (D50=1), and it is determined whether or not the value indicated by the sheet feed counter D50 is equal to the value indicated by the number of already read images D49. Here, since the number of already read images D49 is 1, the value (D50=1) indicated by the sheet feed counter D50 becomes equal to the value (D49=1) indicated by the number of already read images D49, and the last sheet D52 is set to 1.

Moreover, the print page setting processing shown in FIG. 16 is executed, the individual image data stored in the image storage address D53 corresponding to the identification number of the original page indicated by the print page number D48 of the readout job data is expanded in the page memory 172, the image data expanded in the page memory 172 is set as the print page data, and the above setting is set as the second sheet-feed preparation signal.

After the print page setting processing, the information relating to the copy mode D43, the post-processing mode D45 and the assortment D46 of the readout job data is transmitted to the print control unit 400 and the post-processing control unit 500 with the printing start signal, and the first sheet-feed preparation signal and the second sheet-feed preparation signal are turned ON. By turning the first sheet-feed preparation signal ON, the first sheet-feed preparation signal including the information relating to the last page, the information relating to the discharge position, and the like is outputted from the control unit 110 through the print control unit 400 to the post-processing control unit 500.

At a time t1, a predetermined time A1 elapses from the time to when the first sheet-feed preparation signal is turned ON. At this time, the first sheet feed signal is turned ON, and the sheets are conveyed from the sheet feed tray 41*a* to the resist rollers 42*a*.

At a time t2, a predetermined time A2 elapses from the time t1 when the first sheet feed signal is turned ON. At this time, the first sheet feed signal is turned OFF, and when the first sheet feed signal is turned OFF, the first sheet-feed preparation signal is turned OFF.

At a time t3, a predetermined time A3 elapses from the time t1 when the first sheet feed signal is turned ON, and the second sheet feed signal is turned ON. When the second sheet feed signal is turned ON, a sheet is conveyed from the resist rollers 42*a* to the transferring device 43*a*. Thereafter, when the tip end of the sheet is detected by the sensor 42*b*, the image write signal PVV is turned ON, and the image writing is started. Then, the image is formed on the sheet of the first page by the set print page data. Moreover, when the image write signal is turned ON, the second sheet-feed preparation signal is turned OFF.

At a time t4, the image writing is ended, the image write signal PVV is switched from the ON state to the OFF state, and then the processing shown in FIG. 17 is executed.

The job data storage address of the job name having the offset amount corresponding to the value N (N=0) indicated by the job execution counter D32 is referred to, and the job data of the job name is read out. Here, the value N indicated by the job execution counter D32 is 0, and accordingly, the offset amount (N+0) of Job 1 becomes 0, and the job data corresponding to Job 1 is read out.

Moreover, the last sheet D52 of the readout job data is set to 1, and accordingly, the first sheet-feed preparation setting processing and the print page setting processing are not executed, and are awaited until the switching of the sheet discharge signal from the ON state to the OFF state.

At a time t5, that is, when the sheet discharge signal is switched from the ON state to the OFF state, the discharge of the sheets to the discharge position (here, the first discharge position because of the assorted sheet discharge position D47=0) based on the information relating to the discharge position, which is included in the first sheet-feed preparation signal inputted from the control unit 110 through the print control unit 400, is completed. Then, the processing shown in FIG. 18 is executed.

The job data storage address of the job name having the offset amount corresponding to the value N (N=0) indicated by the job execution counter D32 is referred, and the job data of the job name is read out. Here, the value N indicated by the job execution counter D32 is 0, and accordingly, the offset amount (N+0) of Job 1 becomes 0, and the job data corresponding to Job 1 is read out.

The value 1 is added to the sheet discharge counter D51 of the readout job data (D51=1), and it is determined whether or not the value (D51=1) indicated by the sheet discharge counter D51 is equal to the value indicated by the number of already read images D49. The value indicated by the sheet discharge counter D51 and the value indicated by the number of already read images D49 are equal to each other, and accordingly, the printing start signal is set to be OFF.

Then, the job data storage address of the job name having the offset amount corresponding to the value N (N=1) indicated by the job execution counter D32 is referred. Here, the value N indicated by the job execution counter D32 is 0, and accordingly, the offset amount (N+1) of Job 2 becomes 1, and the job storage address corresponding to Job 2 is referred.

It is determined whether or not the job data storage address corresponding to Job 2 is 0, that is, whether or not the address in which the job data is stored is not stored in the job data storage address. The job data storage address is not 0, that is, the address in which the job data is stored is stored, and accordingly, it is determined that there is an unexecuted job in the job list R1.

At this time, the execution of Job 1 having the offset amount corresponding to the value (N=0) indicated by the job execution counter D32 is completed. Accordingly, the address stored in the job data storage address corresponding to Job 1 is deleted, and the address stored in the job data storage address of Job 2 having the offset amount corresponding to the value (N=1) obtained by adding 1 to the value N indicated by the job execution counter D32 is advanced to the job data storage address corresponding to Job 1. Then, 1 is added to the job execution counter D32 (D32=1), and the offset amount of Job 1 becomes 1.

Since it is determined that there is an unexecuted job, the printing start processing shown in FIG. 14 is executed, and thereafter, when the image write signal PVV is switched from the ON state to the OFF state, the processing shown in FIG. 17 is executed. Moreover, when the sheet discharge signal is switched from the ON state to the OFF state, the processing shown in FIG. 18 is executed.

Specifically, by the processing shown in FIG. 12, the assorted sheet discharge position D47 is set in the job data created every time the instruction to start each job is received from the printer controller 2*b*. Then, when each job is executed (when the printing start processing shown in FIG. 14 is executed), the first sheet-feed preparation signal including the information relating to the discharge position indicated by the assorted sheet discharge position D47 of the job data is outputted to the post-processing control unit 500, and the sheets are discharged to the discharge position corresponding to the information relating to the discharge position inputted to the post-processing control unit 500. Hence, for example, when the number of jobs D12 is set to 100, the discharge position is switched by every 100 jobs.

As described above, in accordance with this embodiment, the discharge position of the sheets can be switched per the number of jobs. Accordingly, the convenience can be enhanced by reducing a load of work to assort the sheets relating to the plurality of jobs.

Moreover, when the job offset operation button B11 of the copier/printer setting screen G20 is depressed, a user can arbitrarily set whether or not to switch the discharge position of the sheets per the number of jobs, and can arbitrarily set the number of jobs, by which the discharge position of the sheets is switched, by the ON button B21, the OFF button B22 and the number-of-jobs setting area E21, which are displayed on the setting area E2. In such a way, the convenience is enhanced.

Furthermore, for the job in which the assortment setting button B2 of the setup screen G0 is checked, that is, for the job in which the assortment D46 is present by inputting the instruction to switch the discharge position of the sheets in the job itself, the switching of the discharge position of the sheets per the number of jobs is not executed in accordance with the above instruction. In such a way, an intention of the user (to switch the discharge position of the sheets in the job itself) can be reflected.

Moreover, the present invention is not limited to the above-described embodiment, and can be appropriately modified within the scope without departing from the gist thereof.

In accordance with an aspect of a preferred embodiment of the present invention, an image forming apparatus for forming an image on sheets, comprises: a storage unit for storing the number of jobs in which a discharge position of the sheets is switched; a switching unit for switching the discharge position of the sheets; a sheet discharge unit for stacking the sheets; and a control unit for controlling the switching unit to switch the discharge position of the sheets per the number of jobs, which is stored in the storage unit, to discharge the sheets.

In this image forming apparatus, the discharge position of the sheets can be switched per the number of jobs. Accordingly, the load of work to assort the sheets relating to the plurality of jobs can be reduced. Moreover, the intention of the user to switch the discharge position of the sheets in the job itself can be reflected, and the convenience can be enhanced.

Preferably, the image forming apparatus further comprises: a first input unit for inputting an instruction to switch the discharge position of the sheets per the number of jobs; and a second input unit for inputting the number of jobs, wherein the storage unit stores the number of jobs, which is inputted from the second input unit, and the control unit controls the switching unit to switch the discharge position of the sheets per the number of jobs, which is stored in the storage unit, to discharge the sheets when the instruction to switch the discharge position of the sheets per the number of jobs is inputted by the first input unit.

In this image forming apparatus, the user can arbitrarily set whether or not to switch the discharge position of the sheets per the number of jobs, and can arbitrarily set the number of jobs, by which the discharge position of the sheets is switched. In such a way, the convenience is enhanced.

Preferably, the image forming apparatus further comprises: a third input unit for inputting an instruction as to whether or not to switch the discharge position of the sheets in the job itself, wherein the control unit controls the switching unit to switch the discharge position of the sheets per the number of jobs excluding the job in which the instruction to switch the discharge position of the sheets in the job itself is inputted by the third input unit, to discharge the sheets.

In this image forming apparatus, for the job in which the instruction to switch the discharge position of the sheets in the job itself is inputted, the switching of the discharge position of the sheets per the number of jobs is not executed in accordance with the above instruction. In such a way, the intention of the user (to switch the discharge position of the sheets in the job itself) can be reflected.

The present U.S. patent application claims the priority of Japanese Patent Application No. 2007-272441 filed on Oct. 19, 2007, according to the Paris Convention, and the above Japanese Patent Application is the basis for correcting mistranslation of the present U.S. patent application.

What is claimed is:

1. An image forming apparatus for forming an image on sheets, comprising:

a storage unit for storing the number of jobs in which a discharge position of the sheets is switched;

a sheet discharge tray for stacking the sheets;

a switching unit for switching first and second discharge positions of the sheets on the discharge tray;

a control unit for controlling the switching unit to switch alternately the discharge positions of the sheets per the number of jobs, the number of jobs being stored in the storage unit, to discharge the sheets;

a first input unit for inputting an instruction to switch the discharge position of the sheets per the number of jobs;

a second input unit for inputting the number of jobs; and a third input unit for inputting an instruction as to whether or not to switch the discharge position of the sheets in each job, wherein the storage unit stores the number of jobs, which is inputted from the second input unit, and the control unit controls the switching unit to switch alternately the discharge positions of the sheets per the number of jobs, the number of jobs being stored in the storage unit, to discharge the sheets when the instruction to switch the discharge position of the sheets per the number of jobs is inputted by the first input unit, and wherein the control unit controls the switching unit to switch alternately the discharge positions of the sheets per the number of jobs excluding the job in which the instruction to switch the discharge position of the sheets in each job is inputted by the third input unit, to discharge the sheets.

2. The image forming apparatus of claim 1, wherein the storage unit for storing the number of jobs is a nonvolatile memory.

3. The image forming apparatus of claim 1, wherein the storage unit stores a next discharge position in an assortment.

4. The image forming apparatus of claim 1, wherein original data of each job comprises data common to each of original pages and data, each of which is specific to each of the original pages.

* * * * *